US007832366B2

(12) United States Patent
Hutton et al.

(10) Patent No.: US 7,832,366 B2
(45) Date of Patent: Nov. 16, 2010

(54) SOOTBLOWER FRAME ASSEMBLY

(75) Inventors: Kenneth M. Hutton, Stirlingshire (GB); Anthony J. McKay, East Dunbartonshire (GB)

(73) Assignee: Diamond Power International, Inc., Lancaster, OH (US)

( * ) Notice: Subject to any disclaimer, the term of this patent is extended or adjusted under 35 U.S.C. 154(b) by 425 days.

(21) Appl. No.: 10/561,569

(22) PCT Filed: Mar. 2, 2005

(86) PCT No.: PCT/US2005/006710

§ 371 (c)(1),
(2), (4) Date: May 25, 2006

(87) PCT Pub. No.: WO2005/085741

PCT Pub. Date: Sep. 15, 2005

(65) Prior Publication Data

US 2006/0288515 A1 Dec. 28, 2006

Related U.S. Application Data

(60) Provisional application No. 60/549,414, filed on Mar. 2, 2004.

(51) Int. Cl.
*F23J 3/02* (2006.01)

(52) U.S. Cl. ..... 122/379; 122/390; 15/317

(58) Field of Classification Search ..... 122/379, 122/390; 15/316.1, 317
See application file for complete search history.

(56) References Cited

U.S. PATENT DOCUMENTS 3,418,680 A * 12/1968 Rausch ..... 15/317
3,439,376 A 4/1969 Nelson et al.
3,585,673 A 6/1971 Nelson et al.
4,362,108 A 12/1982 Jenkner
4,399,773 A 8/1983 Schwade et al.
4,437,201 A 3/1984 Zalewski
4,803,959 A * 2/1989 Sherrick et al. ..... 122/379
5,353,996 A * 10/1994 Gallacher et al. ..... 239/752
5,675,863 A * 10/1997 Holden et al. ..... 15/316.1
5,752,288 A * 5/1998 Parkin et al. ..... 15/316.1
5,778,830 A * 7/1998 Wall ..... 122/379
6,289,035 B1 * 9/2001 Shver ..... 373/66
6,397,413 B2 * 6/2002 Epstein et al. ..... 5/201
6,575,122 B2 * 6/2003 Hipple ..... 122/379
6,691,646 B2 * 2/2004 Bartels et al. ..... 122/390
6,907,847 B2 * 6/2005 Bartels et al. ..... 122/379

FOREIGN PATENT DOCUMENTS

DE 295 05 936 U1 11/1995
EP 0 335 039 B1 10/1989

(Continued)

*Primary Examiner*—Gregory A Wilson
(74) *Attorney, Agent, or Firm*—Brinks Hofer Gilson & Lione

(57) ABSTRACT

A sootblower frame particularly adapted for long retracting-type sootblowers for cleaning of internal surfaces of large scale combustion devices. The frame, preferably formed from sheet metal stock, incorporates integrally formed surfaces and configuration features which provide for guiding and movement of the sootblower carriage assembly. The side panels of the frame further provide the surface for the mounting of the drive rack by which the carriage is advanced and retracted along the frame.

39 Claims, 29 Drawing Sheets

FOREIGN PATENT DOCUMENTS

| | | | |
|---|---|---|---|
| EP | 0 580 279 | A1 | 1/1994 |
| EP | 0 617 252 | A2 | 9/1994 |
| GB | 1084342 | | 9/1967 |
| JP | 57182013 | | 11/1982 |
| JP | 10 306912 | | 11/1998 |
| WO | WO 01/65179 | A1 | 9/1991 |
| WO | WO 98/25080 | | 6/1998 |
| WO | WO 99/35459 | | 7/1999 |
| WO | WO 2005/085741 | A1 | 9/2005 |

* cited by examiner

SOOTBLOWER FRAME ASSEMBLY

CROSS REFERENCE TO RELATED APPLICATION

This application claims priority to U.S. patent application Ser. No. 60/549,414, filed Mar. 2, 2004.

BACKGROUND OF THE INVENTION

This invention relates generally to a sootblower device for directing a fluid spray against heat exchanger surfaces in large scale combustion devices for cleaning the surfaces, and particularly to such device having improvements in the construction and design of its structural chassis or frame assembly.

Devices generally known as sootblowers are used to clean internal surfaces within boilers, furnaces, or other devices in which a fossil fuel is combusted. Sootblowers typically employ water, steam, air, or a combination thereof as a blowing medium which is directed through one or more nozzles against encrustations of slag, ash, scale, and/or other fouling materials which become deposited on the surfaces.

Typical sootblowers of the long retracting type have a retractable lance tube which is periodically advanced into and withdrawn from the combustion device and is simultaneously rotated such that one or more nozzles at the end of the lance tube project blowing medium jets tracing helical paths.

Conventional sootblowers of the long retracting type use an elongated chassis or frame assembly in which a carriage assembly is driven for movement along the frame. The lance tube is carried by and moved by the carriage. An internal drive mechanism within the carriage causes a drive pinion gear to rotate which meshes with an elongated toothed rack fixed to the frame, driving the carriage for longitudinal motion. Through another set of internal gears of the carriage, the lance tube is caused to rotate as the carriage and lance move longitudinally along the frame. Examples of such sootblower devices include the well known "IK" type sootblower manufactured by the Assignee which is described by U.S. Pat. Nos. 5,920,951 and 5,605,117, which are hereby incorporated by reference.

Manufacturers of sootblower devices are continuously striving to improve their performance and reduce their cost of production, operation, and maintenance. A significant cost factor in the production of a sootblower is the fabrication of its elongated frame. Generally speaking, a long retracting sootblower has a frame with two vertical side panels to which are welded or bolted parallel upper and lower tracks for the carriage to run along. The vertical sides are held apart either by an integral horizontal upper panel or, in the case of some sootblower devices such as Assignee's "IK 600" sootblower, by spacer bars or by cross-bracing. These sootblower frame side panels are typically sheet metal plates to which are connected an "L" shaped angle iron which provides the surface for running the carriage rollers and the toothed drive rack. Each of these components are separately manufactured, fabricated, shipped, and assembled to the frame. This fabrication is an expensive procedure requiring significant labor involvement and the need to fabricate and stock inventory.

The typical assembled sootblower frame requires a high degree of skill and precision in its assembly. The angle iron pieces which form the track surfaces must be accurately aligned and may become misaligned during use. The assembly requirements also mean that assembly operations are best performed at a centralized manufacturing site with specialized fixturing and labor, which limits flexibility in optimizing the supply chain. And finally, a typical sootblower frame is heavier and uses more material than a structurally optimized design.

Long retracting sootblowers require a frame assembly that is strong, stiff and geometrically true, and which allows the accuracy of alignment between the track surfaces for the carriage rollers and for mounting the toothed rack to be precisely maintained relative to each side of the frame. Further, it is difficult to maintain the accuracy of alignment (parallelism) between the surfaces of each rack and tracks.

BRIEF SUMMARY OF THE INVENTION

In accordance with the present invention, a sootblower frame assembly is provided which incorporates side panels or side panel components having preformed integral panel sections which define channels with track surfaces for the carriage rollers as well as providing a surface for the attachment of the toothed drive rack. The integrally formed channels provide stiffening for the side panels and further provide areas for the carrying of control cables and other conduits used in the sootblower assembly.

The concept of the present invention also enables the sootblower frame side panels to be manufactured in a modular fashion, allowing multiple pieces to be assembled to define a desired length of overall sootblower frame. Since the various critical surfaces are integrally formed at the point of manufacture, their dimensional precision and stability can be assured. These components may be shipped to the customer site with assurance that the frame dimensions remain true. Numerous embodiments of this invention are discussed which provide the above noted features.

Further objects, features, and advantages of the invention will become apparent from a consideration of the following description and the appended claims when in taken in connection with the accompanying drawings.

DETAILED DESCRIPTION OF THE PREFERRED EMBODIMENTS

Figure 1:
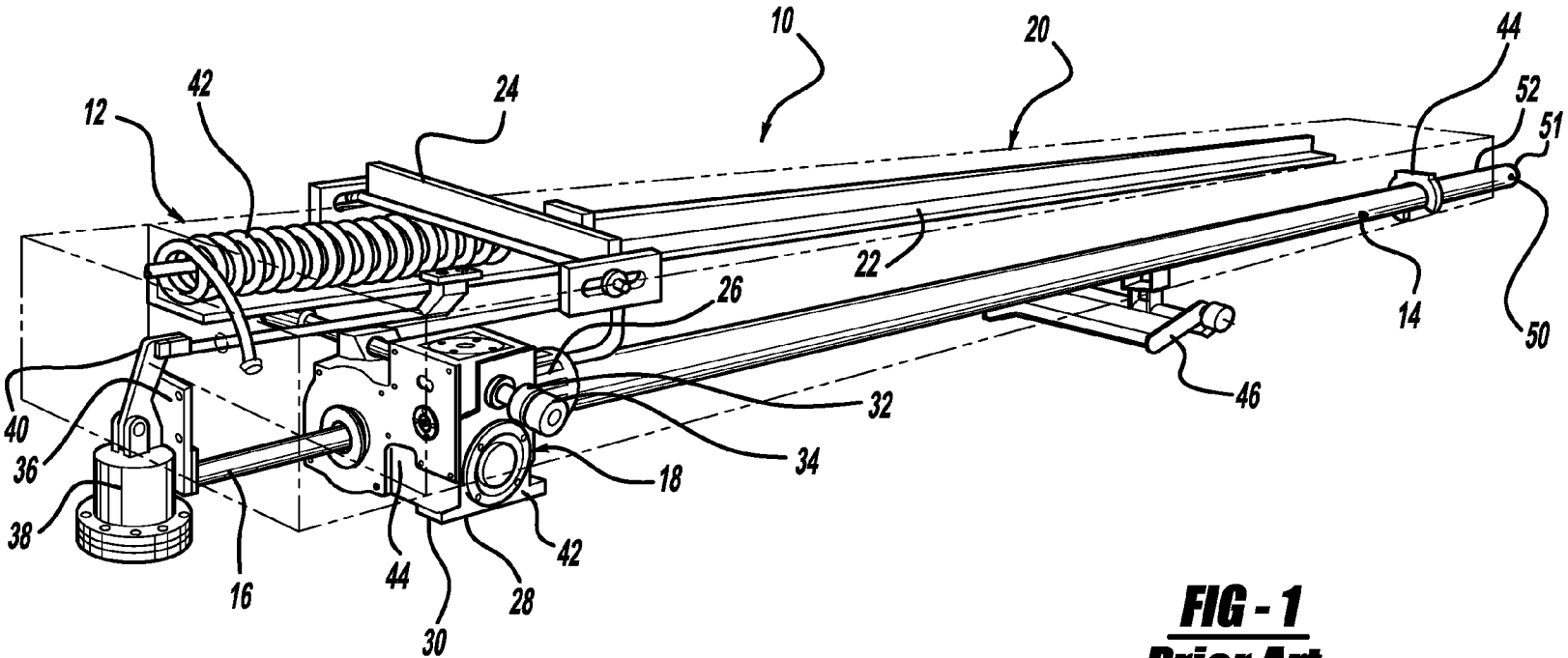
FIG - 1 Prior Art
FIG. 1 is a pictorial view showing a long retracting sootblower having a frame assembly shown in phantom in accordance with the prior art.

A sootblower assembly of a type suitable for incorporation with the present invention is shown in FIG. 1 and is generally designated there by reference number 10. Sootblower 10 principally comprises frame assembly 12, lance tube 14, feed tube 16, and carriage 18. Sootblower 10 is shown in its normal retracted resting position. Upon actuation, lance tube 14 is extended into and retracted from a combustion system, such as a boiler (not shown) and may be simultaneously rotated.

Frame assembly 12 includes a generally rectangular shaped frame 20 which forms a frame or chassis for the entire unit. Carriage 18 is guided along two pairs of tracks located on opposite sides of frame assembly 12, also shown in FIG. 2, including a pair of lower tracks 21 and upper tracks 22. A pair of toothed racks 23 are connected to upper tracks 22 and are provided to enable longitudinal movement of carriage 18. Frame assembly 12 is supported at the wallbox (not shown) at its forward end (at the right in FIG. 1) which is affixed to the boiler wall or another mounting structure, and is further supported by rear support bracket 24 at its rearward end (at the left in FIG. 1).

Carriage 18 drives lance tube 14 into and out of the boiler and includes a drive motor 26 and a gear box 28 which is enclosed by housing 30. Carriage 18 drives a pair of pinion gears 32 which engage with toothed racks 23 to advance carriage 18 and lance tube 14. Support rollers 34 engage upper and lower guide tracks 22 and 21 to support carriage 18.

Feed tube 16 is attached at one end to rear bracket 36 and conducts the flow of cleaning medium which is controlled by the action of poppet valve 38. Poppet valve 38 is actuated through linkages 40 which are engaged by carriage 18 to begin cleaning medium discharge upon extension of lance tube 14, and cuts-off the flow once the lance tube and carriage return to their idle retracted position, as shown in FIG. 1. Lance tube 14 over-fits feed tube 16 and a fluid seal between them is provided by internal joint packing (not shown). A sootblower cleaning medium such as air or steam flows inside of lance tube 16 and exits through one or more nozzles 50 mounted to nozzle block 52 at distal end 51.

Coiled electrical cable 42 conducts power to the drive motor 26. Front support bracket 44 supports lance tube 14 during its longitudinal and rotational motion. For long lance tube lengths, an intermediate support 46 may be provided to prevent excessive bending deflection of the lance tube.

Figure 2:
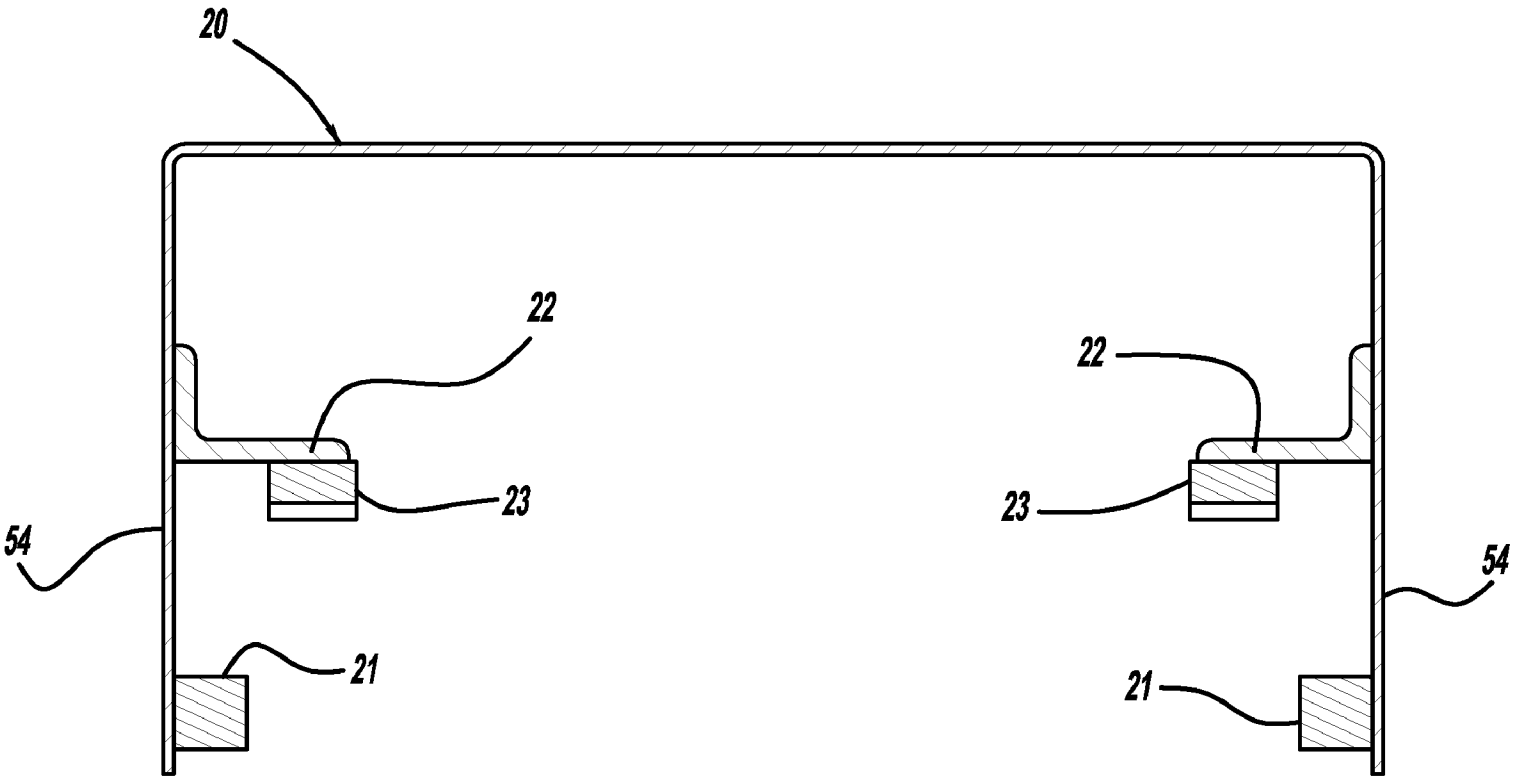
FIG - 2 Prior Art
FIG. 2 is a cross-sectional view showing a sootblower frame assembly configuration in accordance with the prior art.

FIG. 2 shows, in section, frame 20 of a prior art configuration. As illustrated, frame 20 is bent in an inverted "U" configuration. The pair of upper tracks 22 are provided of "L" channel angle iron and are mounted to the inside surfaces of the frame side panels 54. Lower tracks 21 formed of square bar or tube stock are mounted below upper tracks 22 and are also fixed to the frame by welding or threaded fasteners. The gap area formed between upper and lower tracks 22 and 21 defines a channel or pocket which provides guiding surfaces for support rollers 34, allowing the carriage 18 to move along the length of frame 20. Lengths of toothed rack 23 are fixed to the lower surface of upper tracks 22 and are welded or bolted in position and mesh with drive pinion gears 32. As previously discussed, the prior art frame 20 requires a number of separate components which must be fabricated, stocked, and assembled.

Figure 3:
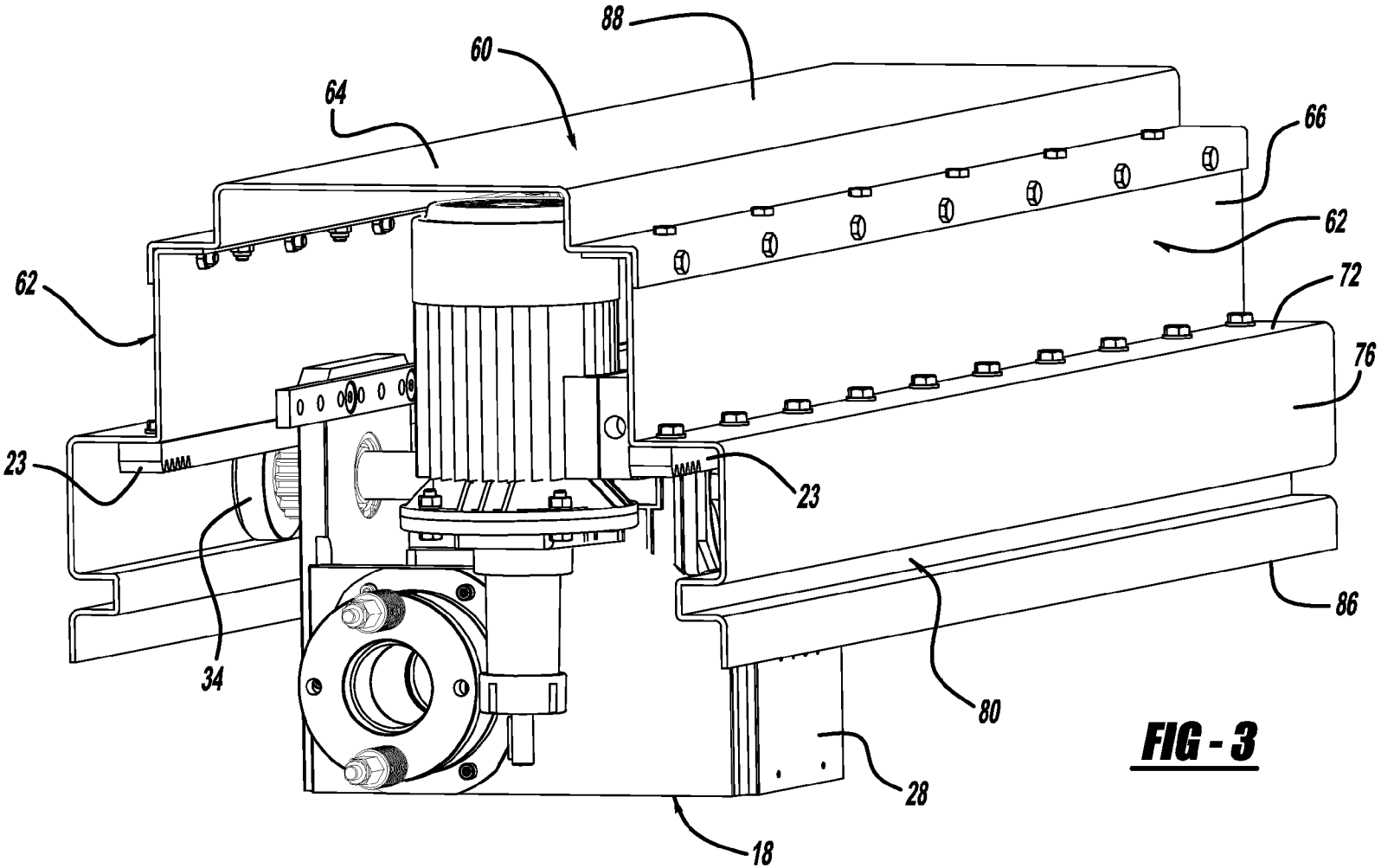
FIG. 3 is a perspective view of a sootblower incorporating a frame assembly in accordance with a first embodiment of the present invention.
Figure 4:
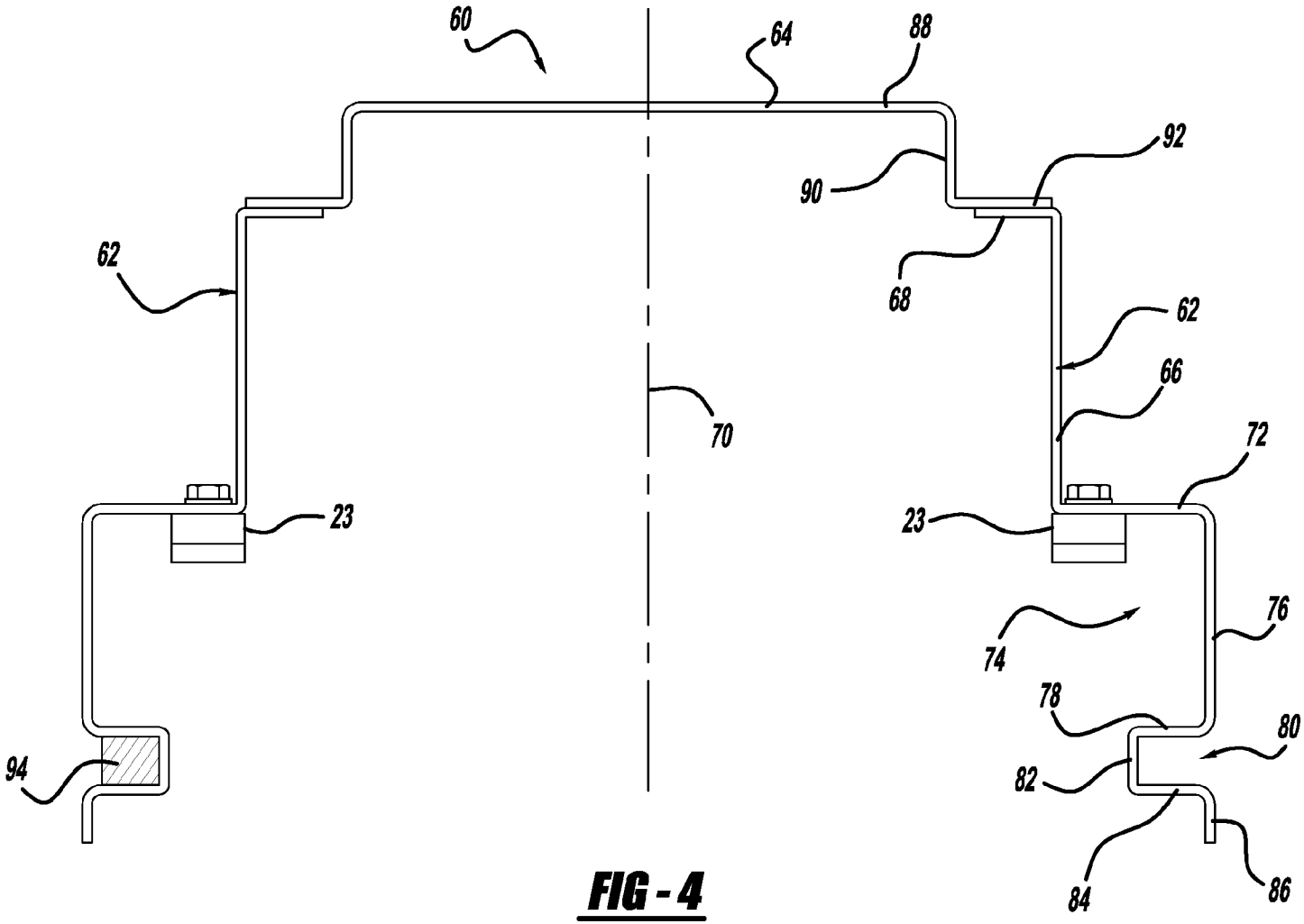
FIG. 4 is cross-sectional view of a frame assembly substantially similar to that shown in FIG. 3.
Figure 5:
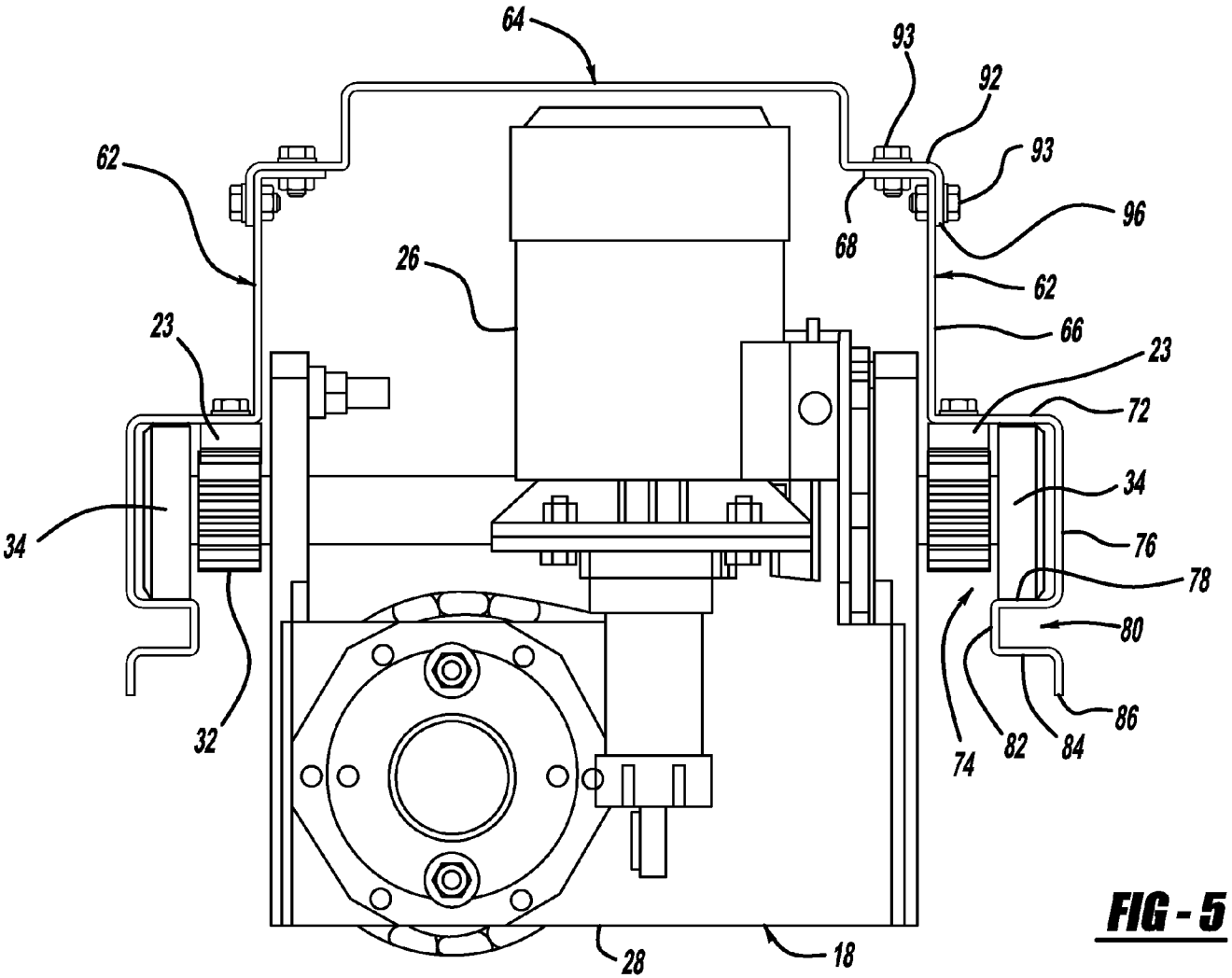
FIG. 5 is an end view of the frame assembly shown in FIG. 3 in accordance with the first embodiment, showing the sootblower carriage in position within the frame assembly.

Now with reference to FIGS. 3, 4, and 5, a frame assembly in accordance with a first embodiment of this invention is shown and is generally designated by reference number 60. Frame assembly 60 includes a pair of opposed side panels 62, one defining a right hand side panel and the other defining a left hand side panel, and top plate 64. In accordance with a principal feature of this invention, side panels 62 are pre-formed to have a configuration which allows them to integrally provide surfaces for the guidance of support rollers 34, as well as a surface for the mounting of toothed rack 23. The upper portion of side panels 62 feature a vertical panel section 66 with an inwardly deflected attachment flange 68.

For purposes of the description of frame assembly 60 and other embodiments of this invention, reference to "inward" or "inboard" refers to the direction toward the vertical-longitudinal center plane 70 of the frame assembly 60 shown in FIG. 4, whereas "outward" or "outboard" refers to the opposite direction. Moreover, "upper" or "upwardly", and "lower" or "downwardly", and "left-hand" and "right-hand" refer to directions for the components as they are illustrated in FIG. 4.

The lower portion of vertical panel sections 66 integrally form an inwardly opening roller channel 74 which defines a guiding pocket or surface for the movement of support rollers 34. Channel 74 includes a horizontal upper panel track surface 72, a vertical side panel section 76, and a lower inwardly deflected horizontal panel track surface 78. In order to provide stiffening for the lower portion of side panel 62 and for other functions which will be subsequently described, channel 74 blends into an outwardly facing channel or pocket 80 formed by panel sections 78, 82 and 84. Free-flange section 86 defines the lower edge of side panels 62. Both the left-hand and right-hand side panels 62 are of mirror image configuration.

Top plate 64 features center panel section 88 and is bent to form an "L" channel configuration 90 along side edges which form flanges 92. Flanges 92 match with side panel attachment flanges 68, enabling these components to be attached. Such assembly can be accomplished through welding or brazing operations, or as preferred for serviceability, threaded fasteners (shown in FIG. 3).

FIG. 5 illustrates sootblower carriage 18 in position within frame assembly 60. As shown, toothed racks 23 are bolted to horizontal upper panel track surface 72 within channels 74. Support rollers 34 are enclosed within channel 74 and ride in contact with the panel track surface 78. The rollers 34 are also restrained by upper track surface 72. Horizontal upper panel track surface 72 extends inwardly a distance greater than that of horizontal panel track surface 78, enabling the rack 23 with its teeth facing downwardly to be positioned to clear support roller 34, and further to "trap" the upper portion of the support roller, with the support roller fitting in the gap between the rack and panel section 76.

The side panels 62 and top plate 64 of frame assembly 60 may be formed from various materials. Ideally, a high yield steel material is selected which can be galvanized on both sides before fabrication. The stock which forms frame assembly 60 would be provided as coil steel of a substantially constant thickness or gauge which are formed to the configurations illustrated by brake forming or roll forming operations. Multiple or progressive forming operations may be provided to define the described configurations.

As is evident from the foregoing description, frame assembly 60 integrally incorporates elements previously required by separately assembled elements including tracks 21 and 22 (as described in connection with FIGS. 1 and 2). This integrated configuration, in addition to minimizing individual components, labor, and other manufacturing issues, further integrally defines, by design, a precise gap between track surfaces 72 and 78 for the movement of support rollers 34. In addition, the desired parallelism between the track surfaces 72 and 78 is also provided. Side panels 62 may include pre-formed holes or cut-outs desired for fasteners, pass-through openings, inspection ports, etc.

The provision of pocket 80 provides a channel through which electrical power cables or other signal cables or conduits may be positioned in a manner protected from environmental conditions. Pocket 80 further stiffens the panels and conveniently allows individual sections to be attached. A short length of bar stock or pin 94 can be installed within pocket 80 as shown in FIG. 4. The bar stock 94 may be used to connect together separately formed panels of the configuration described previously, in a manner similar to assembling section of model railroad track. This allows sootblower 10 to have a modular construction feature, allowing various lengths of the sootblower to be made up, using available parts which may be trimmed to length and attached together as needed to provide the desired overall length. Bar stock 94 may also be used along the entire length of panels 62 to provide structural reinforcement.

Top plate 64, as shown in FIGS. 3 and 5, include a slight variation from that shown in FIG. 4 in that flange 92 further includes a vertically extending free flange edge 96. This allows threaded fasteners 93 to be bolted through top and side surfaces at the connection between side panels 62 and top plate 64.

Figure 6:
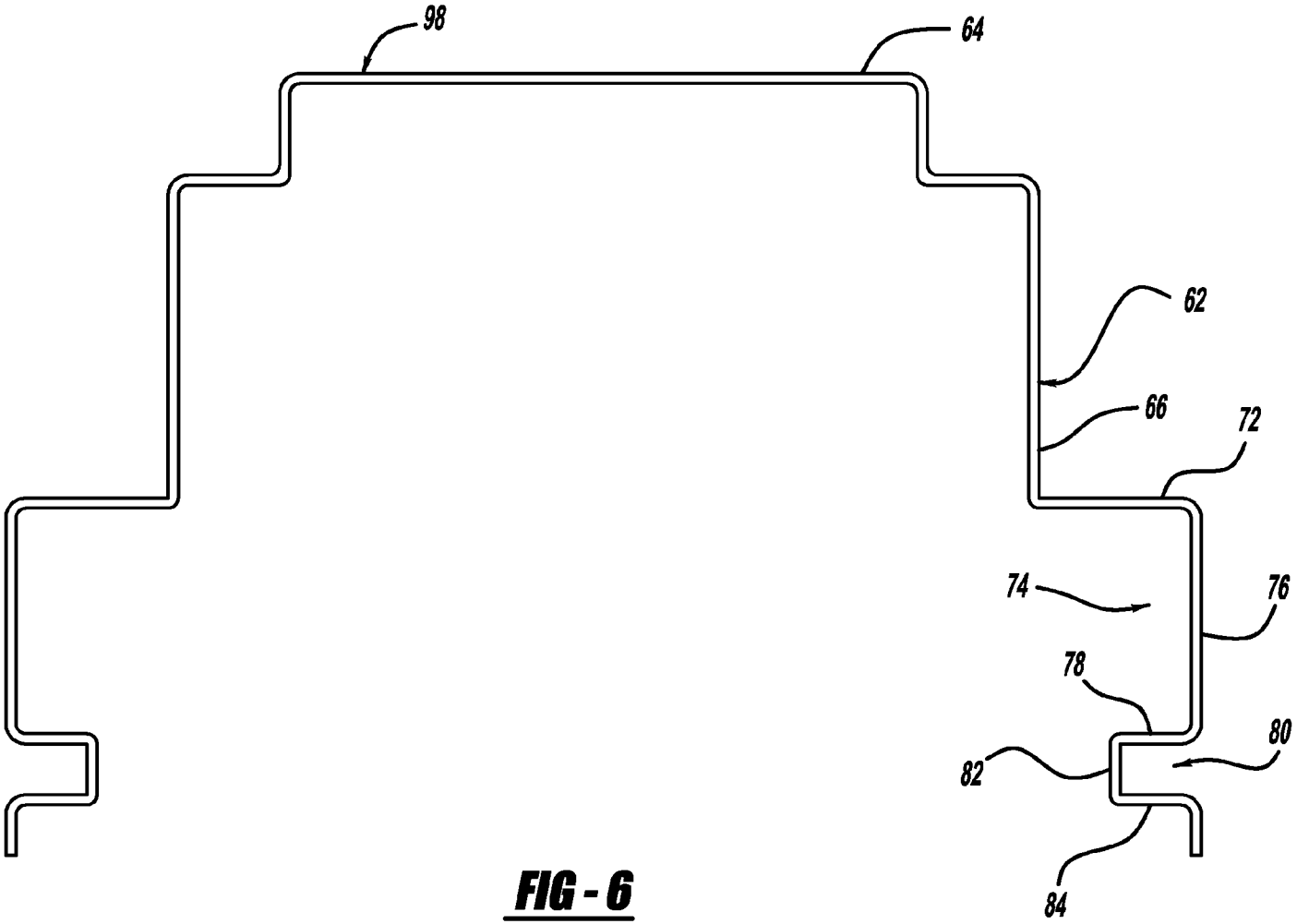
FIG. 6 is a cross-sectional view of a frame assembly in accordance with a second embodiment of this invention.

FIG. 6 illustrates a second embodiment of this invention which in principle is identical to that of the first embodiment except that, in this instance, frame 98 is an integral structure which incorporates the features of side panels 62 and top plate 64. In all other respects, frame 98 would be implemented as described previously in connection with a first embodiment.

Figure 7:
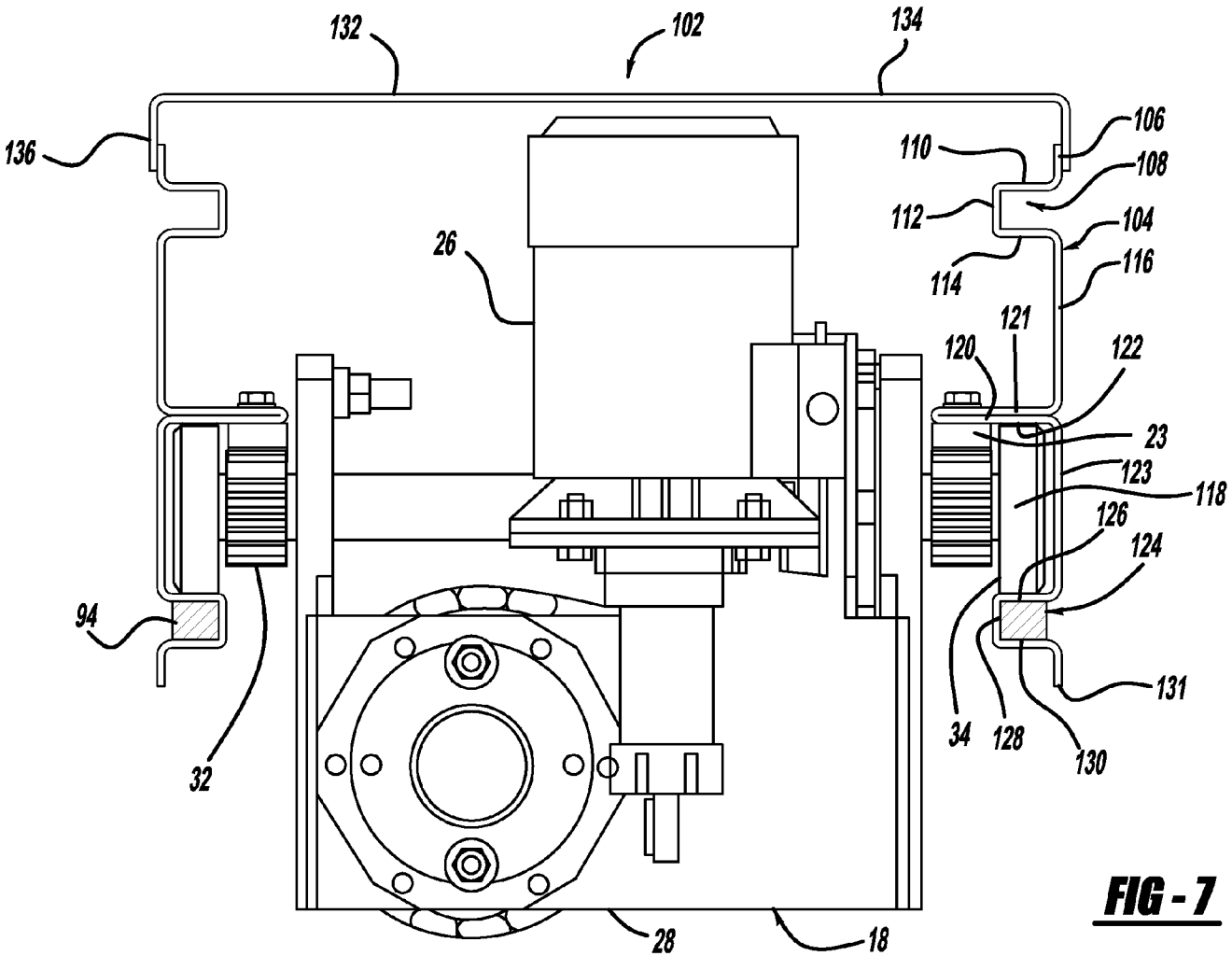
FIG. 7 is an end view of a sootblower incorporating a frame assembly in accordance with a third embodiment of this invention.

Now with reference to FIG. 7, a third embodiment of the present invention is illustrated. In this instance, frame assembly 102 incorporates side panels 104 having a configuration differing from that of side panels 62. Side panels 104 define a vertical upper attachment flange 106, an upper outwardly facing "U" channel shaped pocket 108 formed by panel sections 110, 112, and 114, which blend into center vertical panel section 116. In this embodiment, roller channel 118 is formed by an inwardly directed reversely bent flange 120 having an upper panel section 121 at its upper surface and track surface section 122 defining its lower surface. Panel sections 121 and 122 are "flattened" together, pinched into contact, which is known as a "Dutch fold" formation. Center panel section 123 merges into an outwardly opening U-channel shaped pocket 124 including track surface section 126 and panel sections 128 and 130. Free flange 131 defines the lower edge of side panels 104. Toothed rack 23 is affixed to the upper surface of support roller channel 118 and is bolted through reversely bent flange 120.

For this embodiment, top plate 132 has a simplified configuration including center panel 134 and downwardly deflected vertical attachment flanges 136. As in the prior embodiment, outwardly facing U-channel shaped pockets 108 and 124 provide locations for the running of wiring and further enable individual sections to be connected together using lengths of attaching bar stock 94, as described previously.

Figure 8:
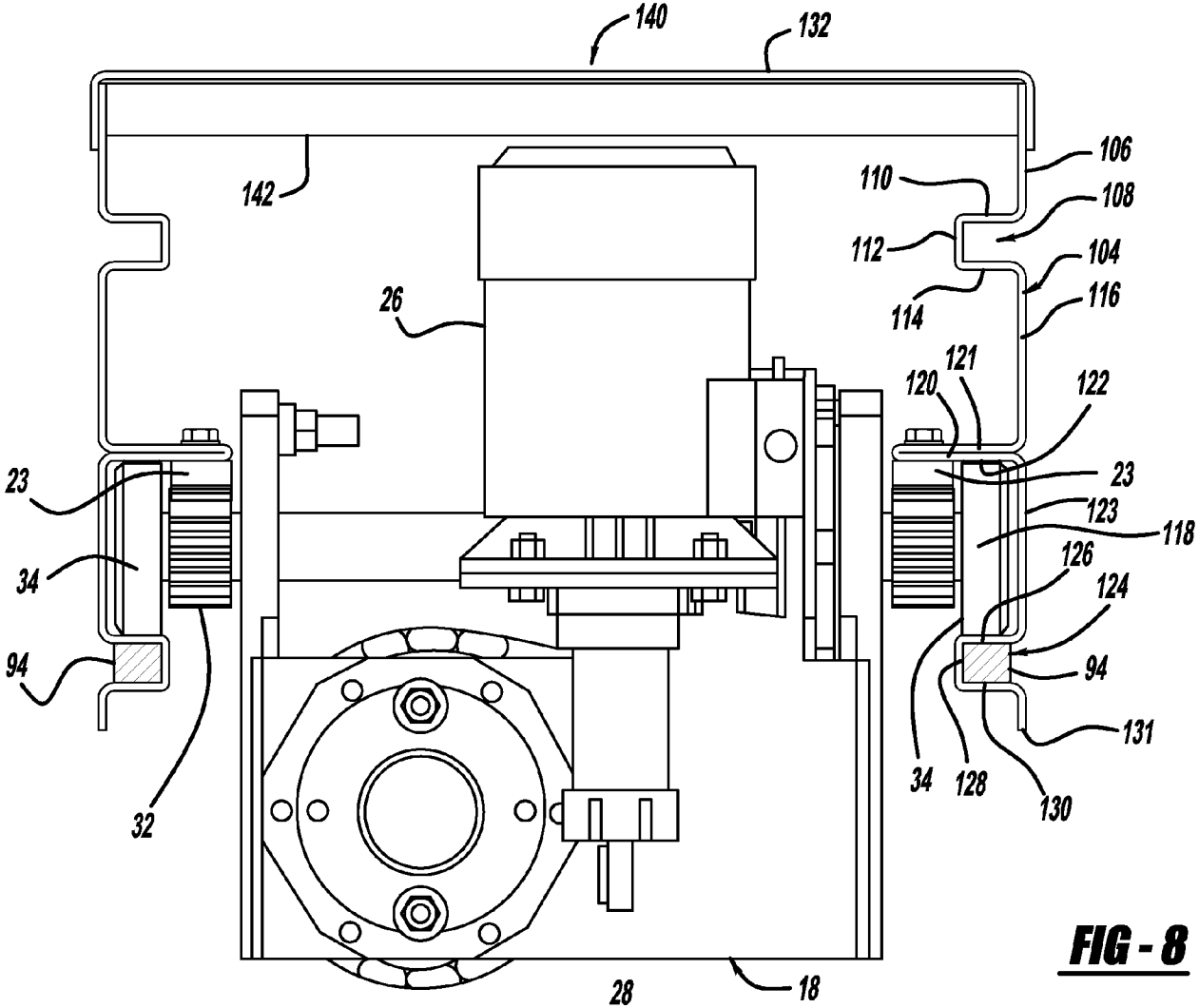
FIG. 8 is an end view showing a sootblower assembly incorporating a frame assembly in accordance with a fourth embodiment of this invention.

FIG. 8 illustrates a fourth embodiment in accordance with the present invention. In this instance, frame assembly 140 includes side panels 104 substantially identical to those described in connection with FIG. 6. In this embodiment, however, top plate 132 is an optional element which may be made of polymeric or very thin sheet metal material for protecting the internal components of a sootblower. A structural connection between the two side panels 104 is provided by a number of tie bars 142 which span between the side panels and are located at regular intervals along the length of frame assembly 140. Alternatively, tie bars 142 may be replaced or supplemented by cross-bracing members or a framework structure.

Figure 11:
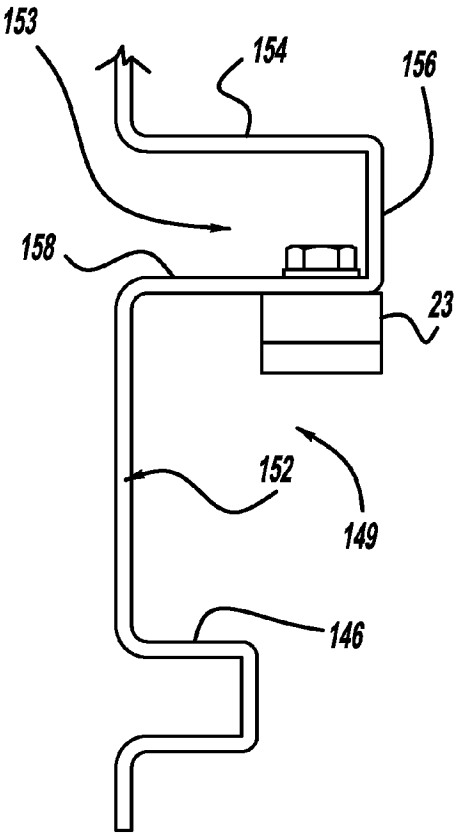
FIG. 11 is a partial cross-sectional view through a sootblower frame assembly in accordance with a seventh embodiment of this invention.
Figure 10:
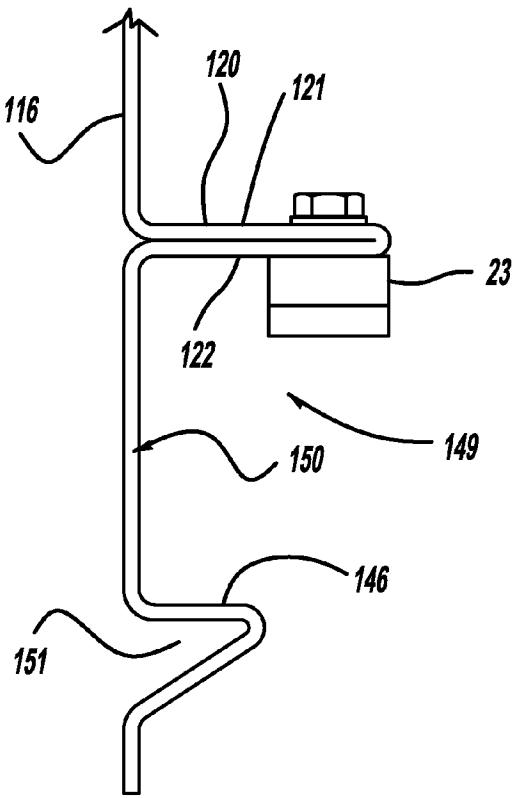
FIG. 10 is a partial cross-sectional view through a sootblower frame assembly in accordance with a sixth embodiment of this invention.
Figure 9:
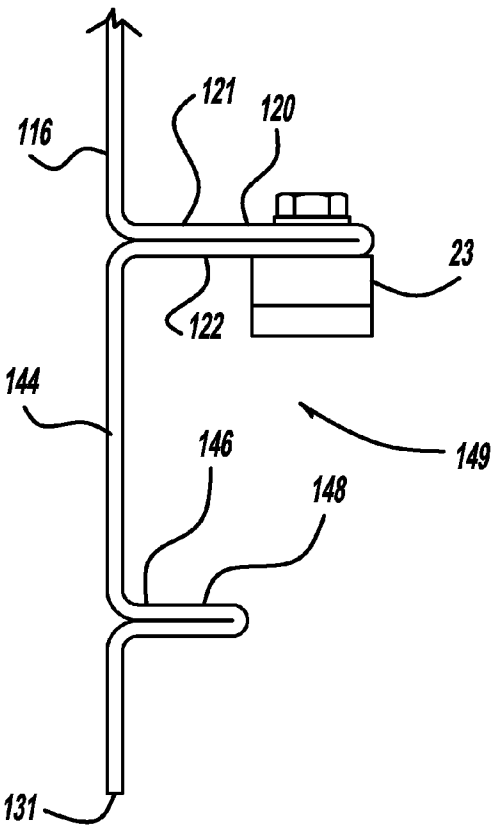
FIG. 9 is a partial cross-sectional view through a sootblower frame assembly in accordance with a fifth embodiment of this invention.

FIGS. 9 through 11 illustrate further alternate embodiments of frame side panels. These figures incorporate some elements described previously, which are identified by the reference numbers mentioned previously for the same features. These figures are shown as partial cross-sections, showing only the portion of the side panels which define the channels or pockets for containing support rollers 34 and the lower free flanged edges. In FIG. 9, side panel 144 includes the features shown in connection with FIGS. 7 and 8 but includes a reversely folded flange 146 in place of pocket 80. The upper portion of the roller channel 149 is formed by flange 120, as described in FIGS. 7 and 8. Roller track surface 148 and upper track surface 122 provide surfaces for supporting rollers 34.

FIG. 10 illustrates the side panel 150 which is modified from that shown in FIGS. 7 and 8 in that the lower outwardly facing pocket 151 is not rectangular in cross-section as pocket 80, but rather forms an open triangular cross-sectional configuration.

FIG. 11 illustrates an alternate embodiment of side panel 152 in which the upper surface of the support roller channel 149 is formed by an outwardly opening pocket 153 formed from panel sections 154, 156, and 158.

Figure 12:
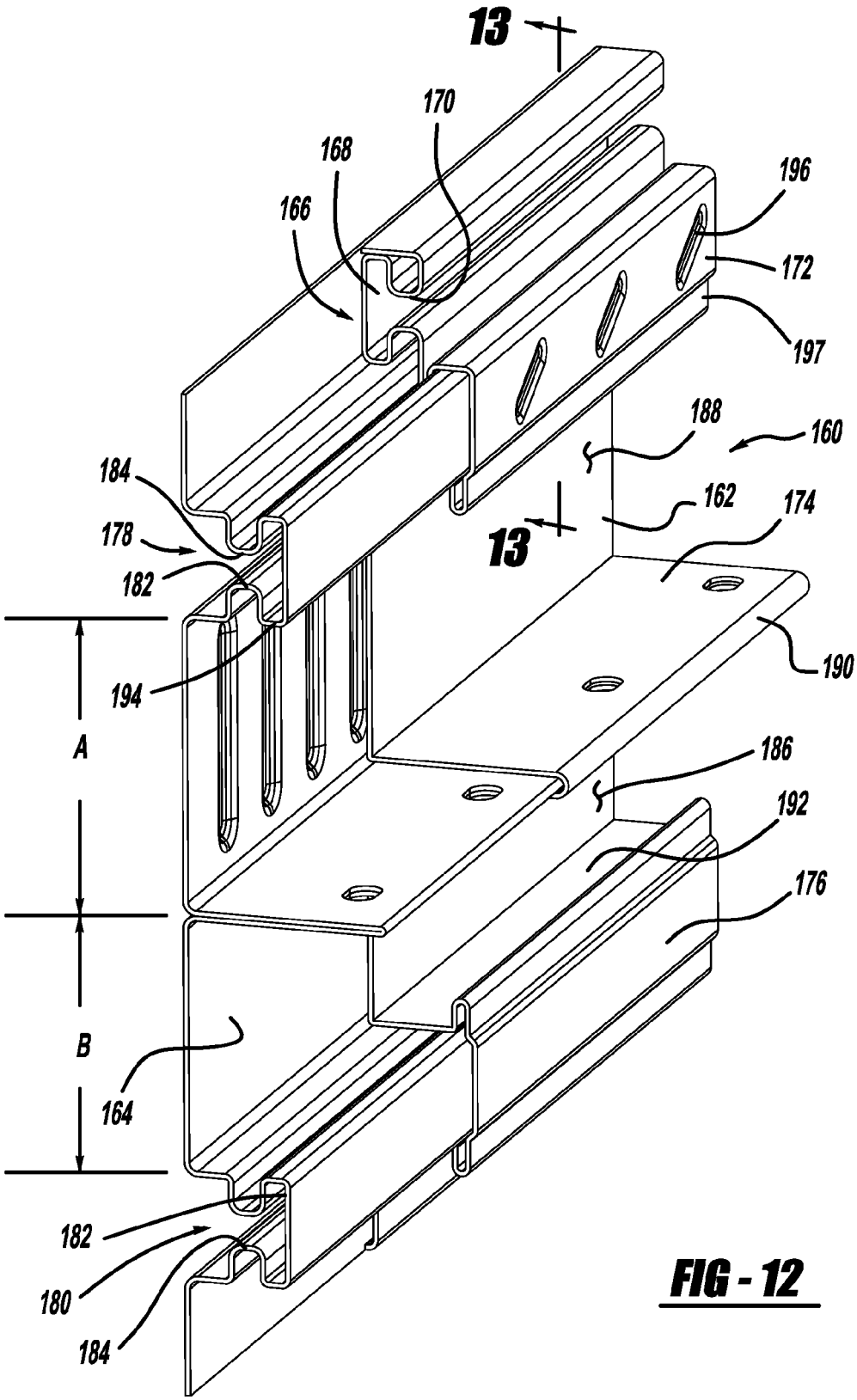
FIG. 12 is an end elevational view of a sootblower frame in accordance with an eighth embodiment of this invention showing multiple preformed sheet metal panels assembled together to form the frame assembly.
Figure 13:
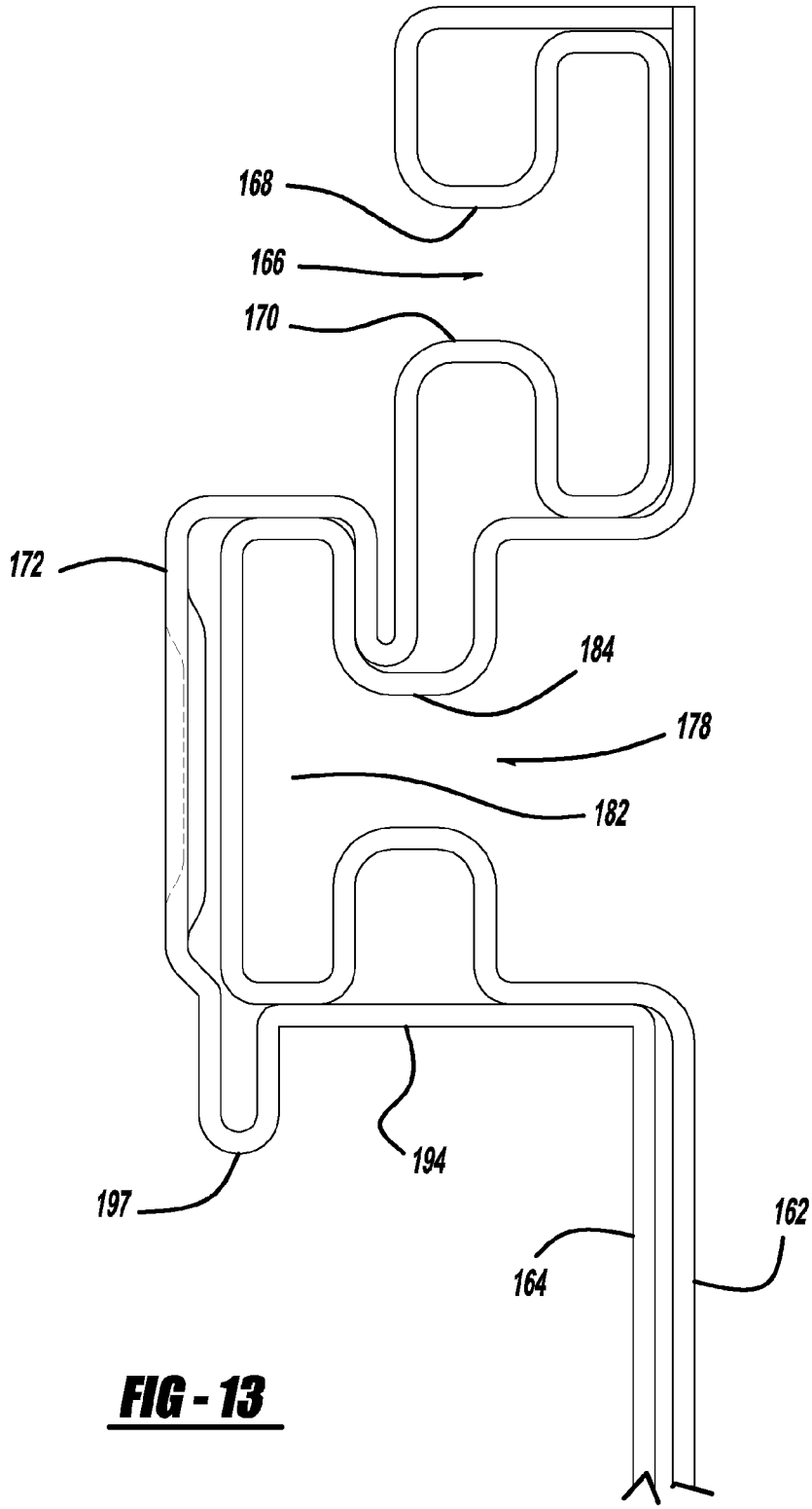
FIG. 13 is a cross-sectional view taken along line 13-13 from FIG. 12.

FIGS. 12 and 13 illustrate a frame assembly in accordance with an eighth embodiment of this invention which is generally designated by reference number 160. Frame assembly 160 is a composite structure formed by assembling two separately formed sheet metal side panels, including an inner side panel 162 and an outer side panel 164. Inner side panel 162 forms an upper formed profile section 166 which forms an internal "T" slot 168 with necked down gap 170. Profile section 166 blends into rail section 172 and forms mid-extending pinch flange 174. Lower rail section 176 features bends for stiffening purposes.

Outer side panel 164 features upper "T" slot profile section 178 and lower "T" slot profile section 180. Both profile sections include internal wide slots 182 and neck down gaps 184. The outer side panel profile "T" slots 178 and 180, as well as inner panel formed profile "T" slot 166 provide a means for convenient engagement of threaded fasteners, bars, nuts, and other fasteners which can be slid into the respective "T" slots and engaged by threaded fasteners which extend through the respective necked down slots. The provision of such profile section reduces the number of preformed holes and other features necessary to provide locations for threaded or other fasteners.

Frame assembly 160 forms a pair of roller channels adapted for providing clearance for support rollers 34. A configuration of frame assembly 160 is adapted for use with different diameter rollers and associated pinion gear pitch diameters. Frame assembly 160 forms a pair of roller channels 186 and 188. Channel 186 is defined by flange 190 and the generally horizontal roller track surface 192. The separation distance between flange 190 and roller track surface 192 is designated by dimension "B" shown in FIG. 12. In a similar manner, channel 188 defines a separation gap distance identified by reference number "A" formed between flange 190 and horizontal roller track surface 194. Dimensions A and B differ from one another and are matched to the two generally used pitch diameters of pinion gears presently used for soot-blower applications. These include a 12 tooth pinion gear and a 16 tooth pinion gear. Frame assembly 160 and side panels 162 and 164 can simply be inverted to present either channel 186 or 188 for use with a particular desired pinion gear pitch diameter. In this manner, frame assembly 160 can be used for either pinion gear application without modifying the side panel 160.

Inner side panel 162 and outer side panel 164 are designed to be closely nested or inner fit upon one another. It is also possible in a co-forming operation to begin forming the features of inner and outer side panels 162 and 164 separately, whereas in final stages of the roll forming operation, the two panels are brought together to form the composite structure illustrated in FIG. 12. It is further possible to form the panels 162 and 164 to interlock together to prevent them from becoming separated. FIG. 12 further illustrates a pair of walls or lips 197 and 198, formed at the inboard edge of roller track surfaces 192 and 194 respectively. Lips 197 and 198 embrace the carriage rollers, keeping them constrained to move within channels 186 and 188, and further reducing the required stiffness of the side panels 160. Dimples 196 may be provided in one or both side panels to enhance stiffening of the composite structure.

Figure 14:
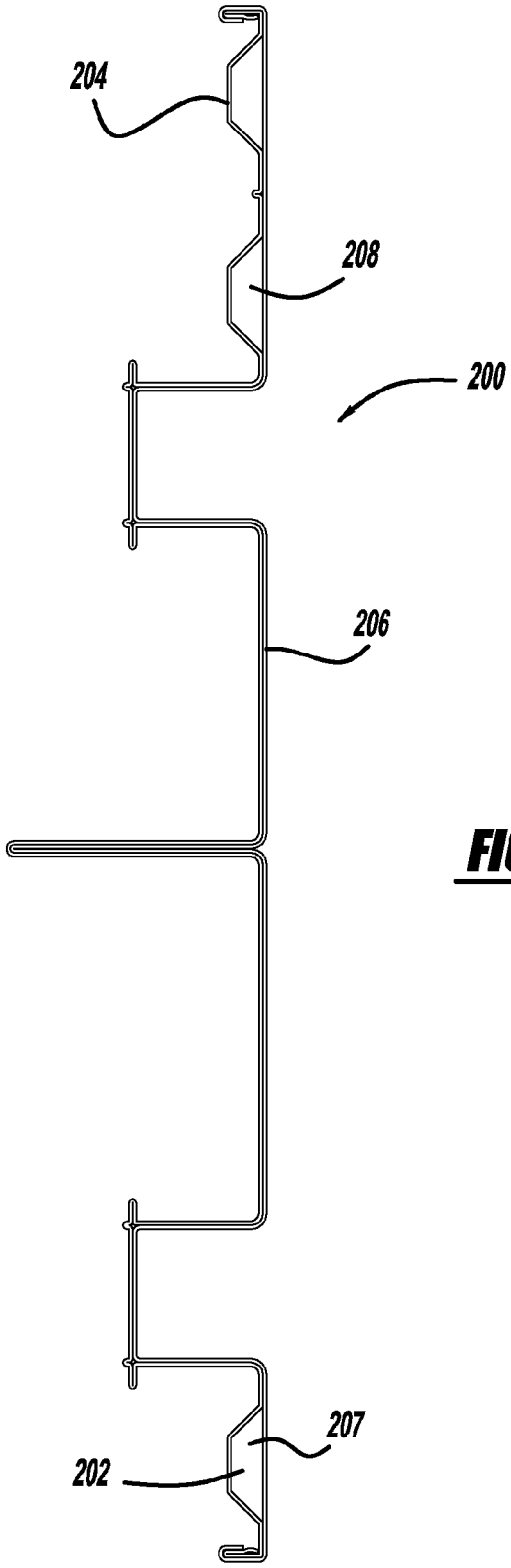
FIG. 14 is a cross-sectional view through a sootblower frame assembly in accordance with a ninth embodiment of this invention showing a frame having multiple closed section internal channels.

Now with reference to FIG. 14, frame side panel assembly 200 is illustrated in accordance with a ninth embodiment of this invention. In this instance, the panel assembly 200 is formed as a composite structure, much like the panel illustrated in FIGS. 12 and 13. In this case, however, separate panels are added to the main structure which may be welded or otherwise affixed to the main panel 106. Panel sections 202 and 204 combine with panel 206 to form internal closed box sections 207 and 208. These box sections 207 and 208 significantly increase the bending and torsional stiffness of side panel assembly 200. Features of panel assembly 200 equivalent to features described in other embodiments are designated with the same element numbers.

An alternate potential manufacturing technique for forming the panel assembly 200 shown in FIG. 14 is to attach panel sections 202 and 204 to main panel 206, and then injecting a hydraulic fluid in the internal cavities formed between the panels in a process known as hydroforming. In such processes, appropriately shaped tools form the final cross-sectional configuration of the assembly.

Figure 15:
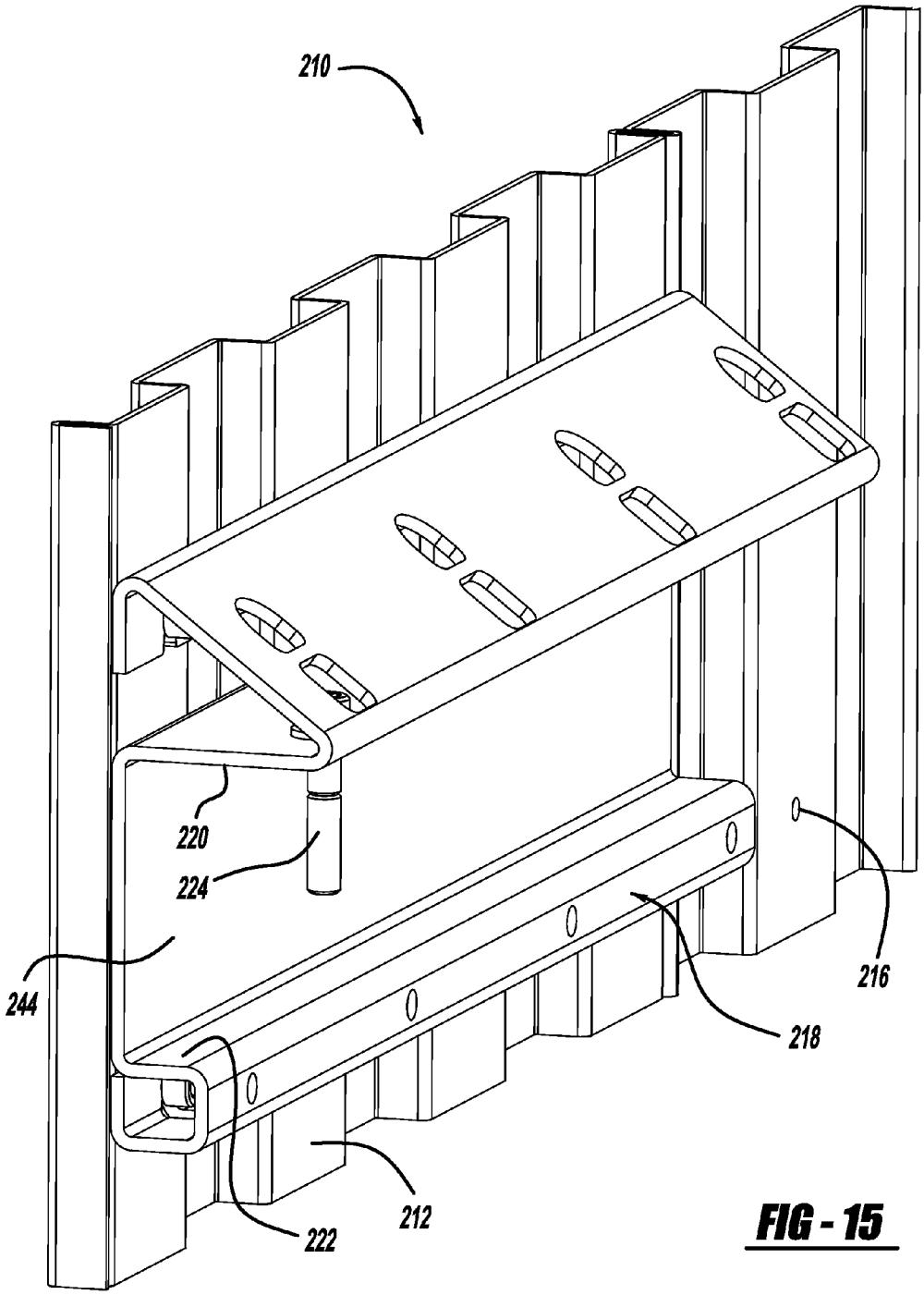
FIG. 15 is a pictorial view of a sootblower frame assembly in accordance with a tenth embodiment of this invention.
Figure 16:
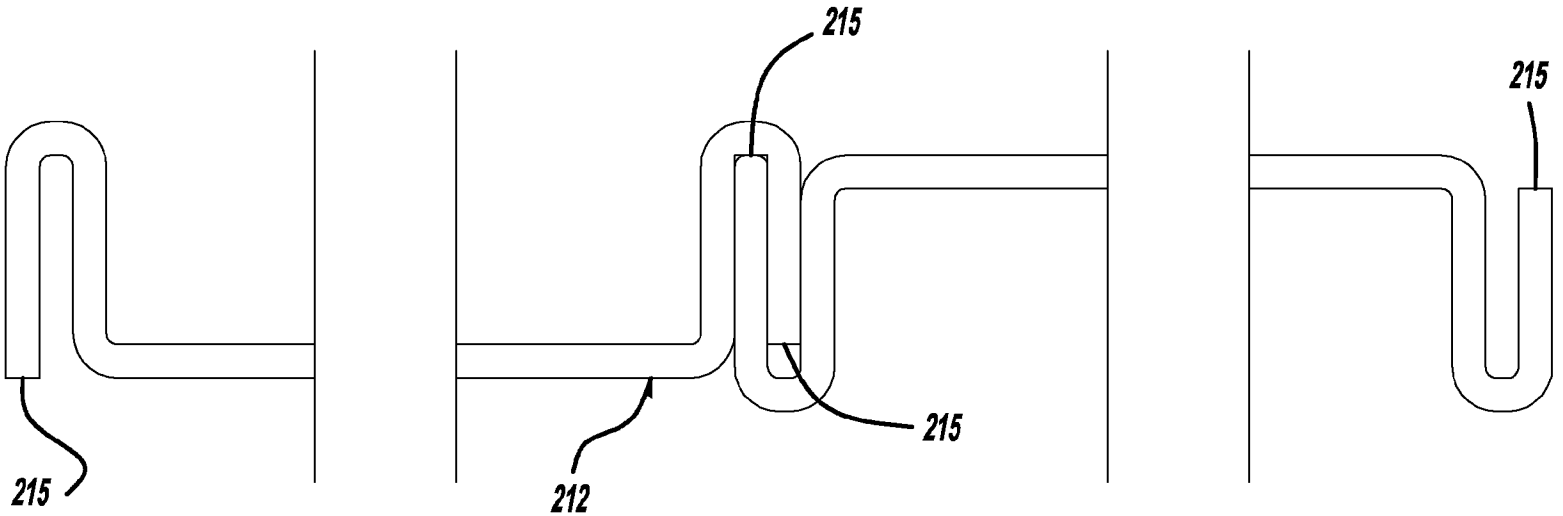
FIG. 16 is a cross-sectional view of a side panel which is an alternative to the construction shown in FIG. 15.
Figure 17:
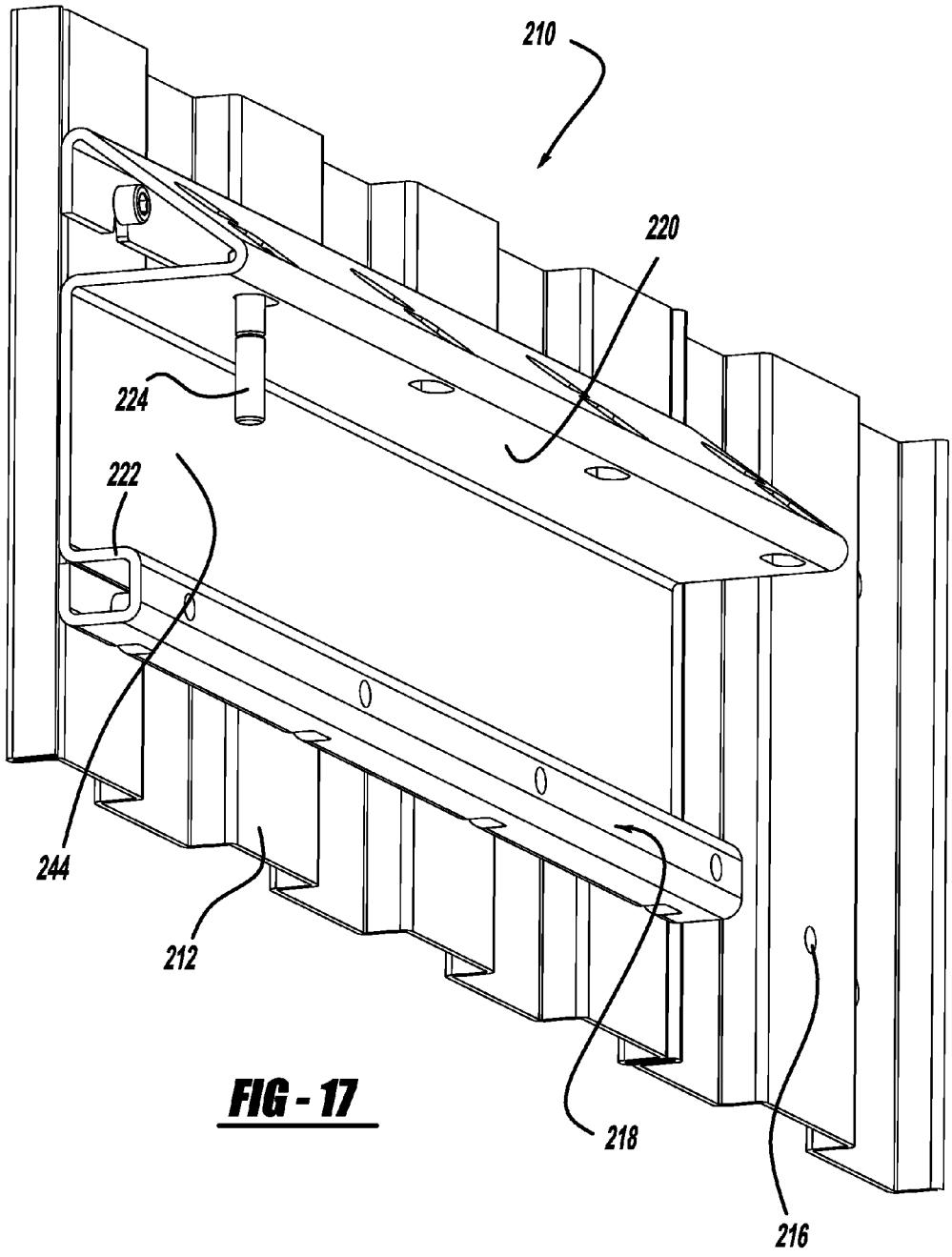
FIG. 17 is a pictorial view of a portion of the sootblower frame assembly shown in FIG. 15.

Now with reference to FIGS. 15, 16, and 17, a frame panel assembly in accordance with a tenth embodiment of this invention is illustrated and generally designated by reference number 210. In this instance, panel assembly 210 has a corrugated side panel 212 having corrugations in the vertical direction as shown in the figure. Side panel 212 may be formed as a one piece or a continuous strip of material having corrugations formed in them as shown in FIG. 15. Alternatively, side panel 212 can be comprised of individually formed sections which have meshing flanges 215, allowing any number of sections to be joined together, as illustrated in the cross-sectional view of FIG. 16. Side panel 212 may have preformed holes 216 for fastening of additional components as is described below.

Formed rail section 218 is formed from sheet metal and is bolted to side panel 212, as best shown by FIG. 17. Rail sections 218 include an upper horizontal panel track surface 220 and a lower horizontal track surface 222 which together form roller channel 244 for receiving the carriage roller and pinion gears, as previously described. Fastener 224 is illustrated as useful for attaching the upper toothed rack (not shown) within channel 222. Fasteners 225 affix rail sections 218 to side panel 212.

The embodiment of FIG. 15 could be used with a separate lower rail section and upper rail section which are separately formed from rail section 218 are positioned at the end of the rail section and are provided to be readily detached from side panel 212. Such separately formed rail sections would be of a limited length and positioned at the end of travel of the carriage at the rearward end of the sootblower. Such separate rail sections would be provided to facilitate the removal and servicing of the carriage 18 without loosening and disassembling the entirety of rail sections 218, which may have a significant length.

Figure 18:
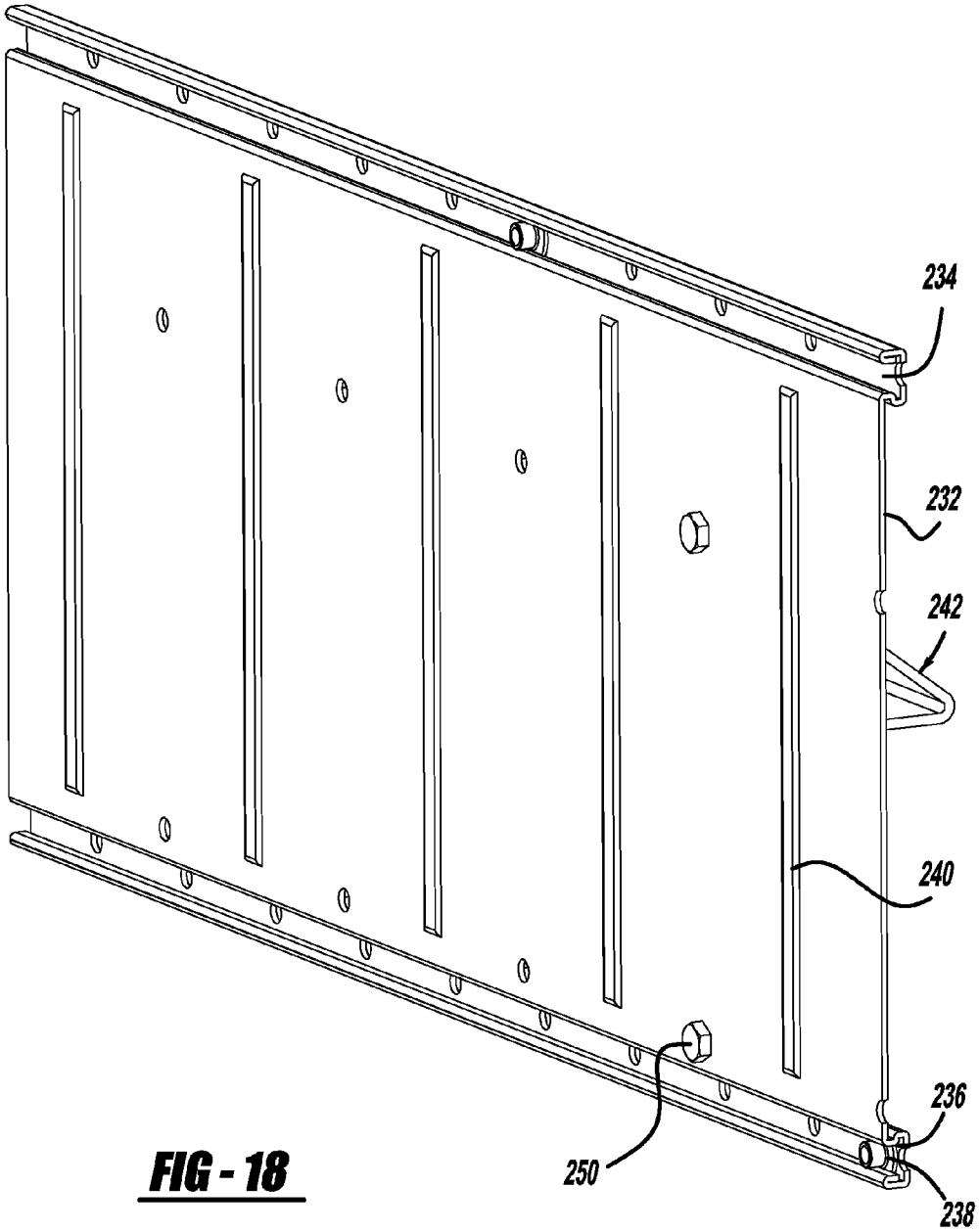
FIG. 18 is a pictorial view of a sootblower frame assembly in accordance with a eleventh embodiment of this invention.
Figure 19:
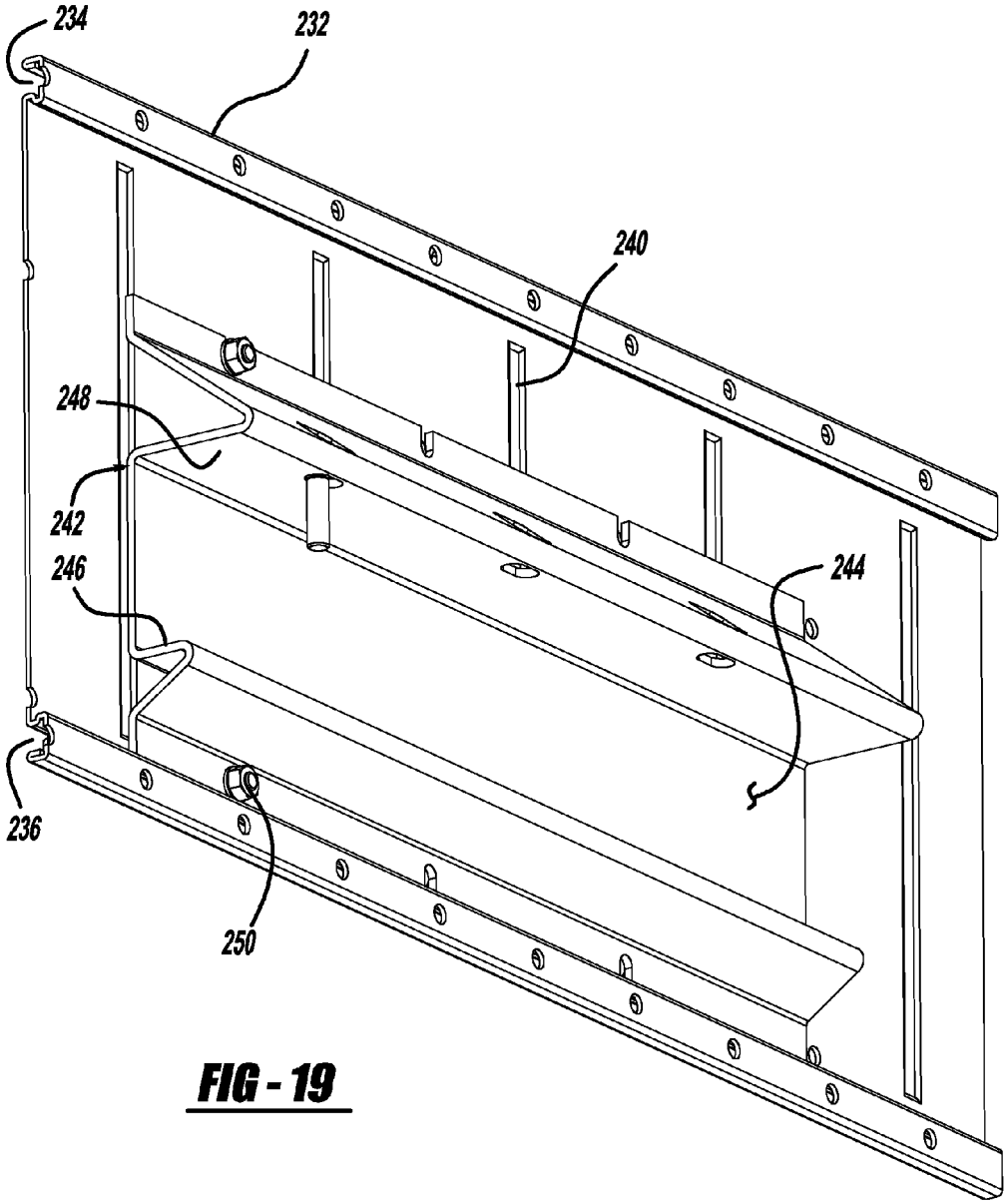
FIG. 19 is a pictorial view of the sootblower frame assembly shown in FIG. 18 showing the inside surface of the frame panel.

FIGS. 18 and 19 illustrate side panel assembly 230 in accordance with an eleventh embodiment of this invention. Panel assembly 230 features a generally planar side panel 232 having upper and lower "T" slot profile channels 234 and 236. The profile channels 234 and 236 enable a "T" nut fastener 238 to be positioned within the profile channels and moved along the channels to the appropriate location for receiving and fastening with a threaded fastener. Side panel 232 is generally planar between the profile sections 234 and 236 except that vertically extending stiffening ribs 240 are provided to enhance the structural integrity of the side panel. Rail sections 242, generally similar to rails sections 218 described in connection with a prior embodiment, is used for panel assembly 230. Like the prior embodiments, a roller channel 244 is formed between upper and lower generally horizontal roller track surfaces 246 and 248. Threaded fasteners 250 are used to connect rail section 242 to the side panels. Individual lengths of side panel 232 can be attached using a threaded bar fit within T-slot channels 234 and 236.

Figure 20:
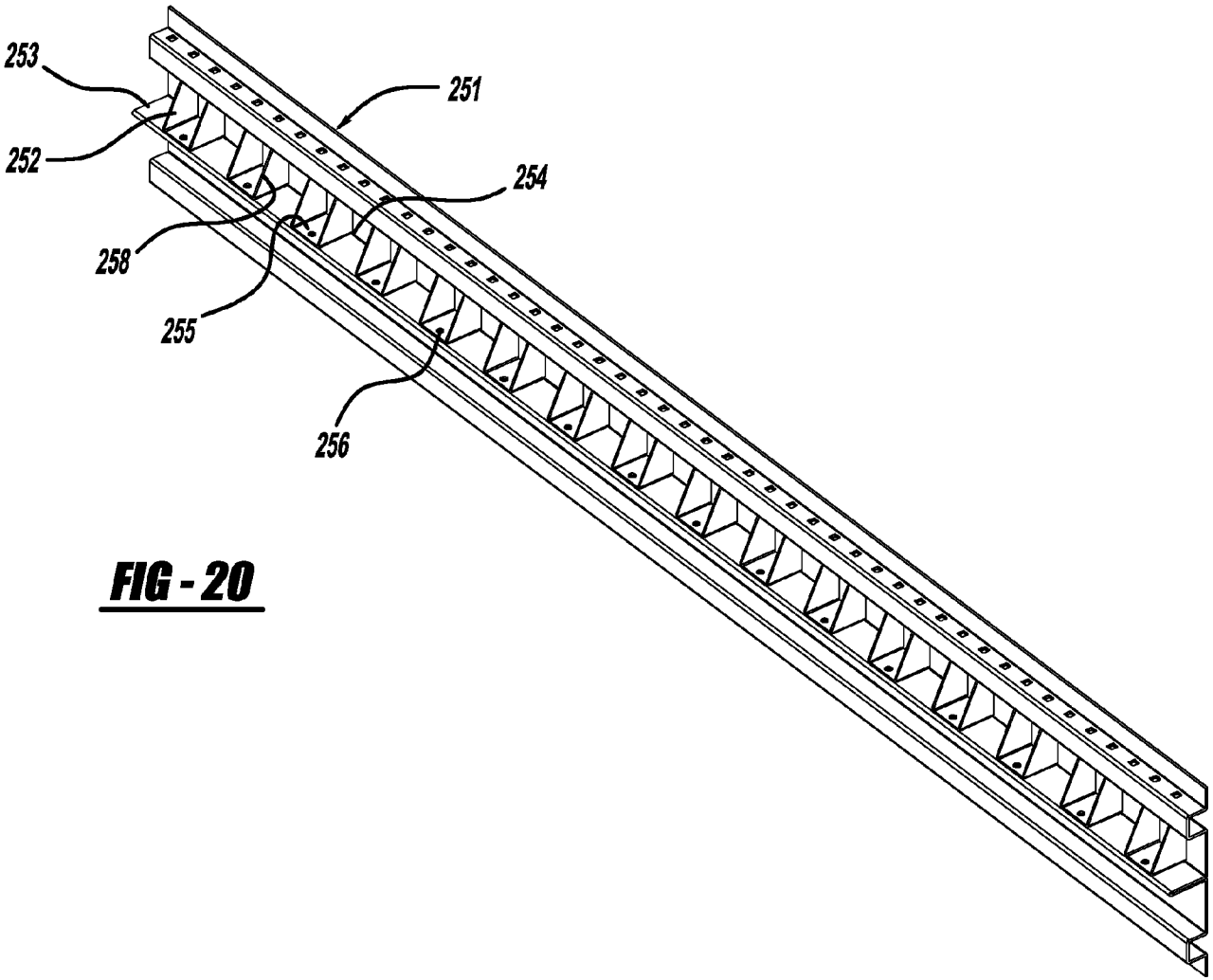
FIG. 20 is a pictorial view of a sootblower frame assembly in accordance with this invention incorporating stiffening brackets in accordance with a twelfth embodiment of this invention.
Figure 21:
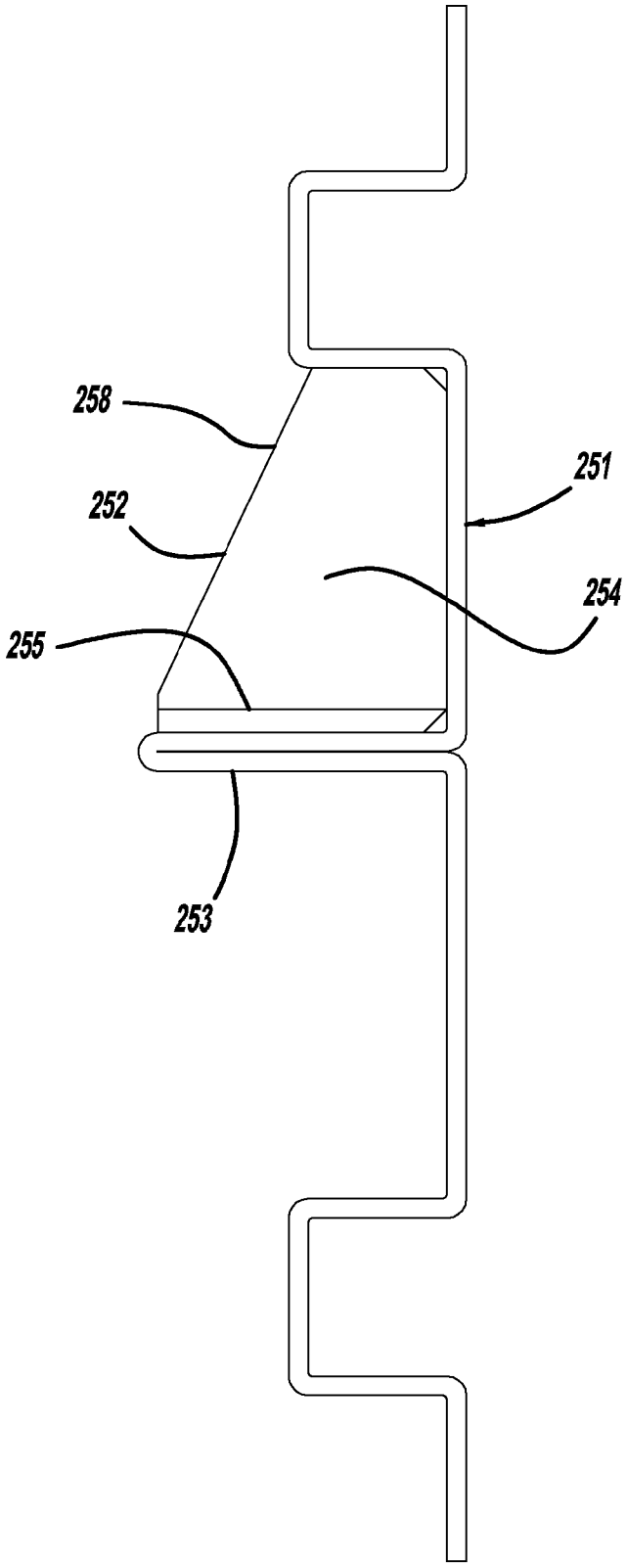
FIG. 21 is a side elevational view partially in cross-section and partially in an elevation view of the sootblower frame assembly shown in FIG. 20.

FIGS. 20 and 21 illustrate frame assembly side panels 251 using reinforcing brackets 252 which can be fit in an unused roller guide channel 254 in designs such as those accommodating two different pinion pitches as described previously and illustrated in FIGS. 8 and 12. In the illustration of FIGS. 20 and 21, the upper guide channel 254 is not used for accommodating the carriage roller and pinion gear. In order to reinforce side panels 251, individual brackets 252 are added to fill in and bridge the unused channel. Brackets 252 can be welded or otherwise affixed to the protruding flange section 253. The center bridge portion 255 of each bracket 252 can incorporate a fastener hole 256 for convenient fastening. The upward extending legs 258 may be welded or otherwise affixed to the upper surface of the channel or simply may be jammed in position. Even without welding or bonding, the legs 258 restrain compressive loads acting on the channel 254.

Figure 22:
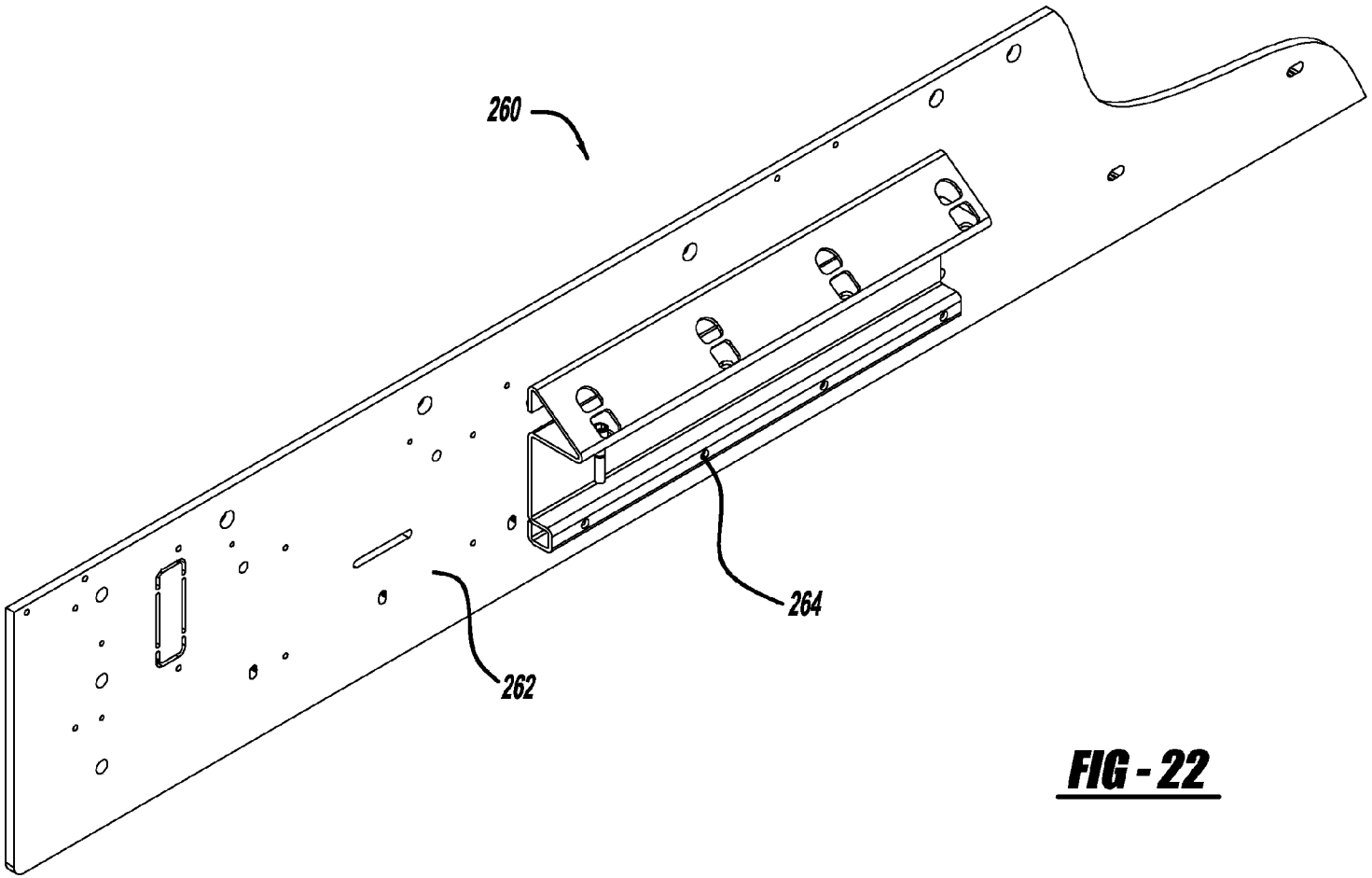
FIG. 22 is a side pictorial view of a sootblower frame assembly in accordance with a twelfth embodiment of this invention showing a flat plate side panel with a bolted-on rail having preformed features.

FIG. 22 illustrates a frame assembly 260 in accordance with a twelfth embodiment of this invention. In this case, side panel 262 is made of substantially flat plate stock material of a type which is available in standard supply from steel manufacturers. Rail sections 264, identical to those described in connection with the embodiment shown in FIG. 17, are bolted to side panels 262.

Figure 23:
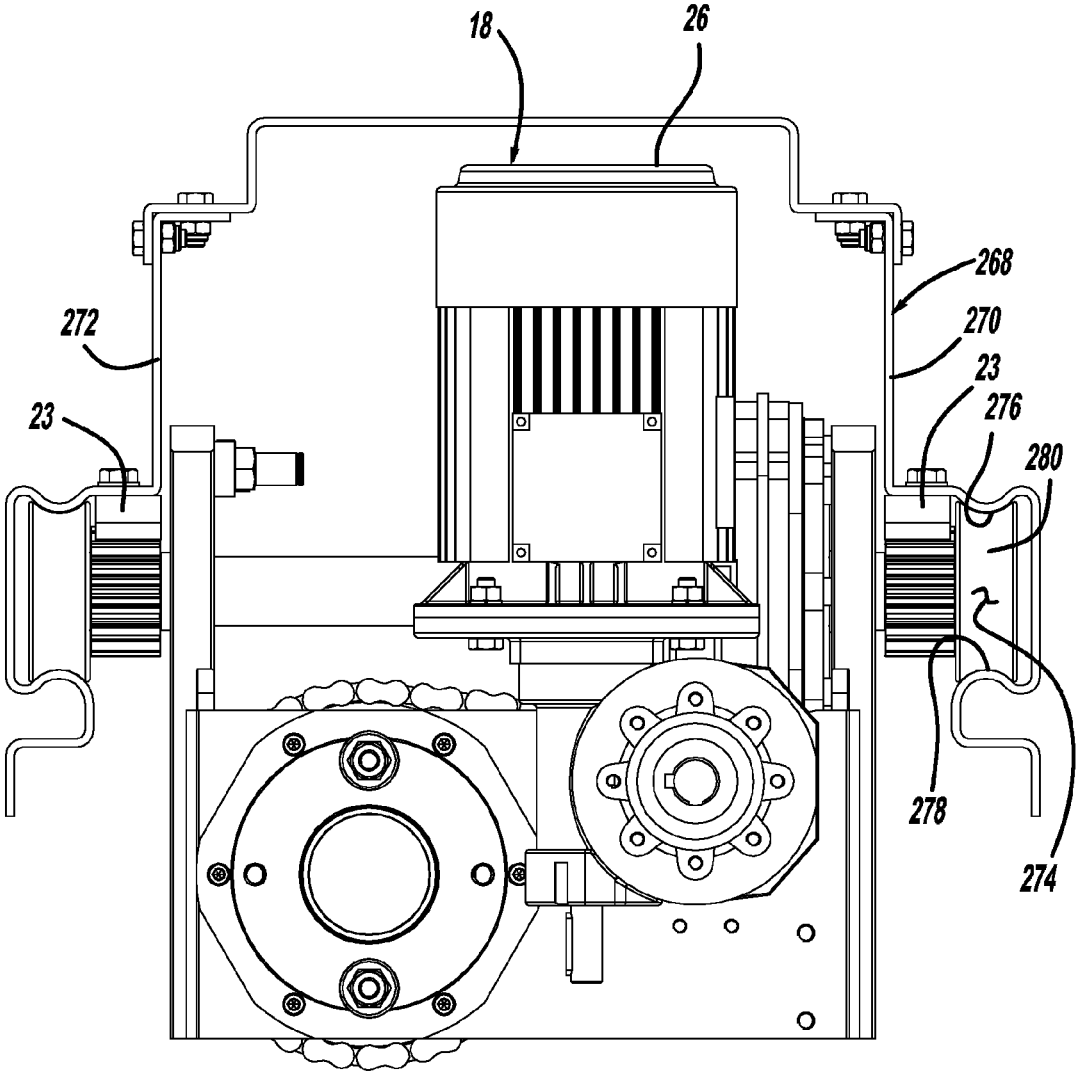
FIG. 23 is a side elevational view of a sootblower frame assembly in accordance with a thirteenth embodiment of this invention showing the horizontal track surfaces having a crowned surface shape for engaging the carriage rollers.

Now with reference to FIG. 23, a frame assembly 268 is illustrated in accordance with a thirteenth embodiment of this invention. Frame assembly 268 includes side panels 270 and 272 having channels for receiving the carriage guide rollers having a cross-sectional configuration differing from those of the previous embodiments. In the case of frame assembly 268, roller channels 274 are formed by an upper track surface 276 and a lower surface 278 which have a crowned or convex shape in cross-section. These surfaces 276 and 278 engage with correspondingly concave or grooved surfaces of modified roller 280. Although roller 280 is shown contacting both track surfaces 276 and 278, as with prior embodiments, some clearance would be provided to prevent binding of the rollers as the carriage 18 moves along the side panels 270 and 272. This configuration of frame assembly 268 would allow the interaction between rollers 280 and the upper and lower surfaces 276 and 278 to "self-align" the rollers with the channels in the horizontal direction. However, as in the case of prior embodiments, rollers 180 rotate about a horizontal axis and the weight of the carriage acts vertically on the side panels.

Figure 24:
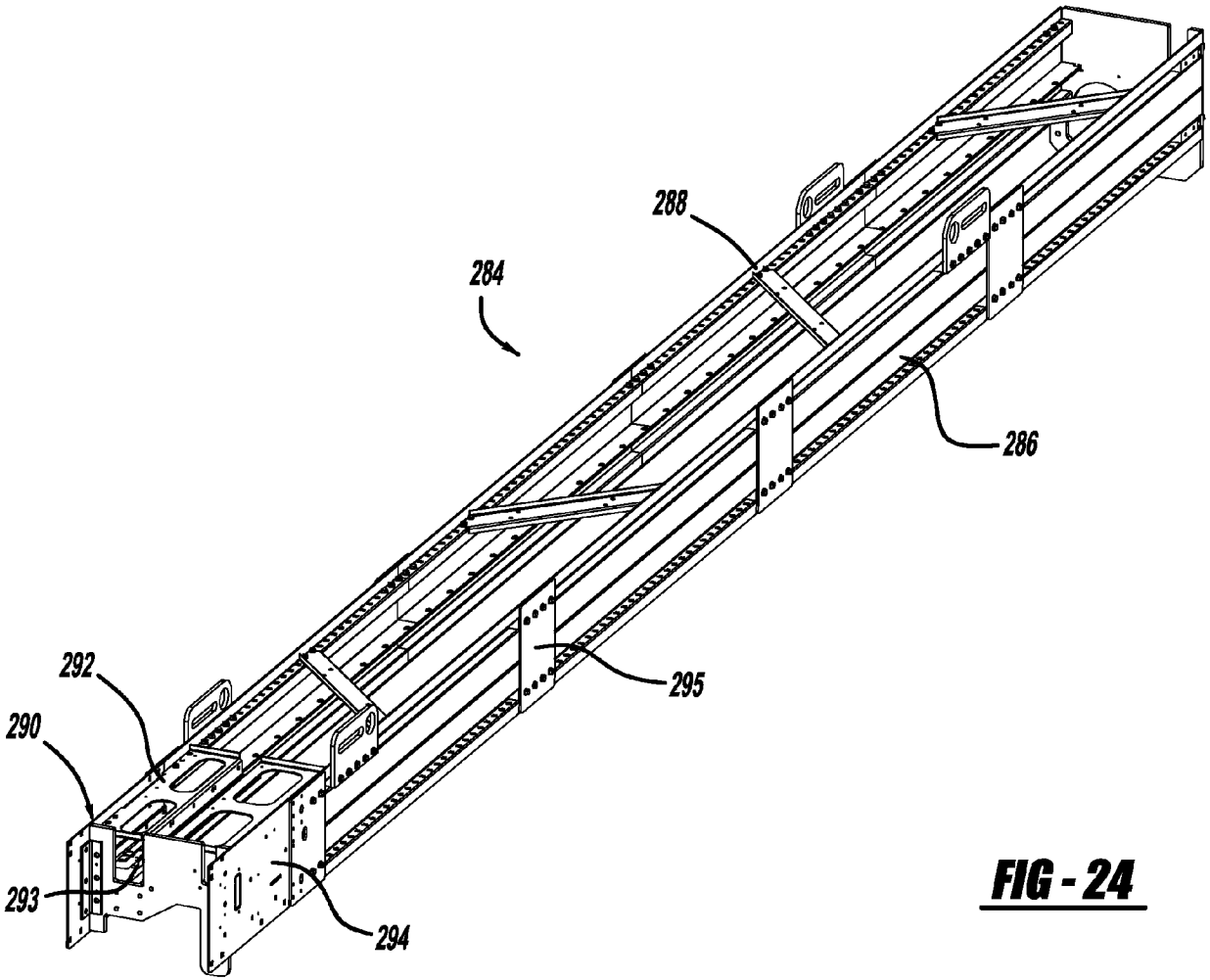
FIG. 24 is a pictorial view of a sootblower frame assembly in accordance with a fourteenth embodiment of this invention showing a separately mounted rearward end module.
Figure 25:
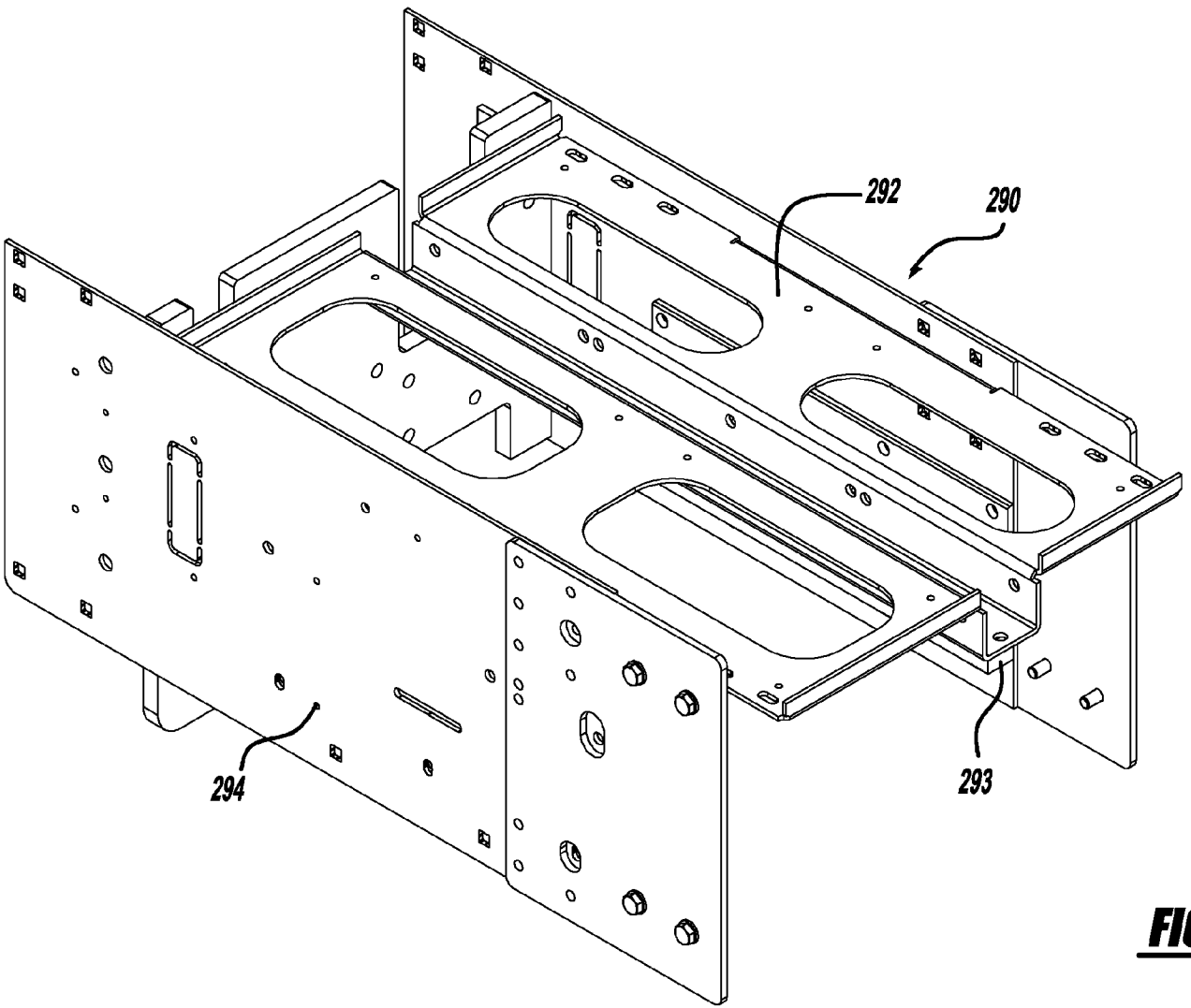
FIG. 25 is a pictorial view of the rearward end module shown in FIG. 24.

Now with reference to FIG. 24, a frame assembly in accordance with a fourteenth embodiment is illustrated and generally designated by reference number 284. As in prior embodiments, side panel assemblies 286 and 288 are elongated for forming the main sections of the frame assembly along its length. However, one disadvantage of unitary side panels which form the full length of channels for guiding carriage 18, is difficulty in removing the carriage from such an assembly, since the carriage rollers are trapped vertically within the performed roller channels. To address the serviceability concern, frame assembly 284 includes a removable rear module 290 which is a box structure which is separately fastened to side panel assemblies 286 and 288 and, as previously mentioned, is provided for convenient servicing of the sootblower device. FIG. 25 illustrates rear module 290 in more detail. The various plates which form rear module 290 could be bolted together to provide a maximum of flexibility in servicing, including the ability to remove the top plate 292 for servicing the top portion of the carriage or removing it in an upper direction, and removable side plates 294 for servicing from the side surfaces. Separate upper track section 293 and lower track section are provided which can be bolted to side plates 294 to allow the carriage 18 to be released to drop from the bottom of rear module 290 or lifted upwardly. Rear module 290 further preferably provides the control features for actuating poppet valve 38. Individual sections of side panel assemblies may be connected in a co-linear manner using side attachment plates 295 which are bolted to the panels.

Figure 26:
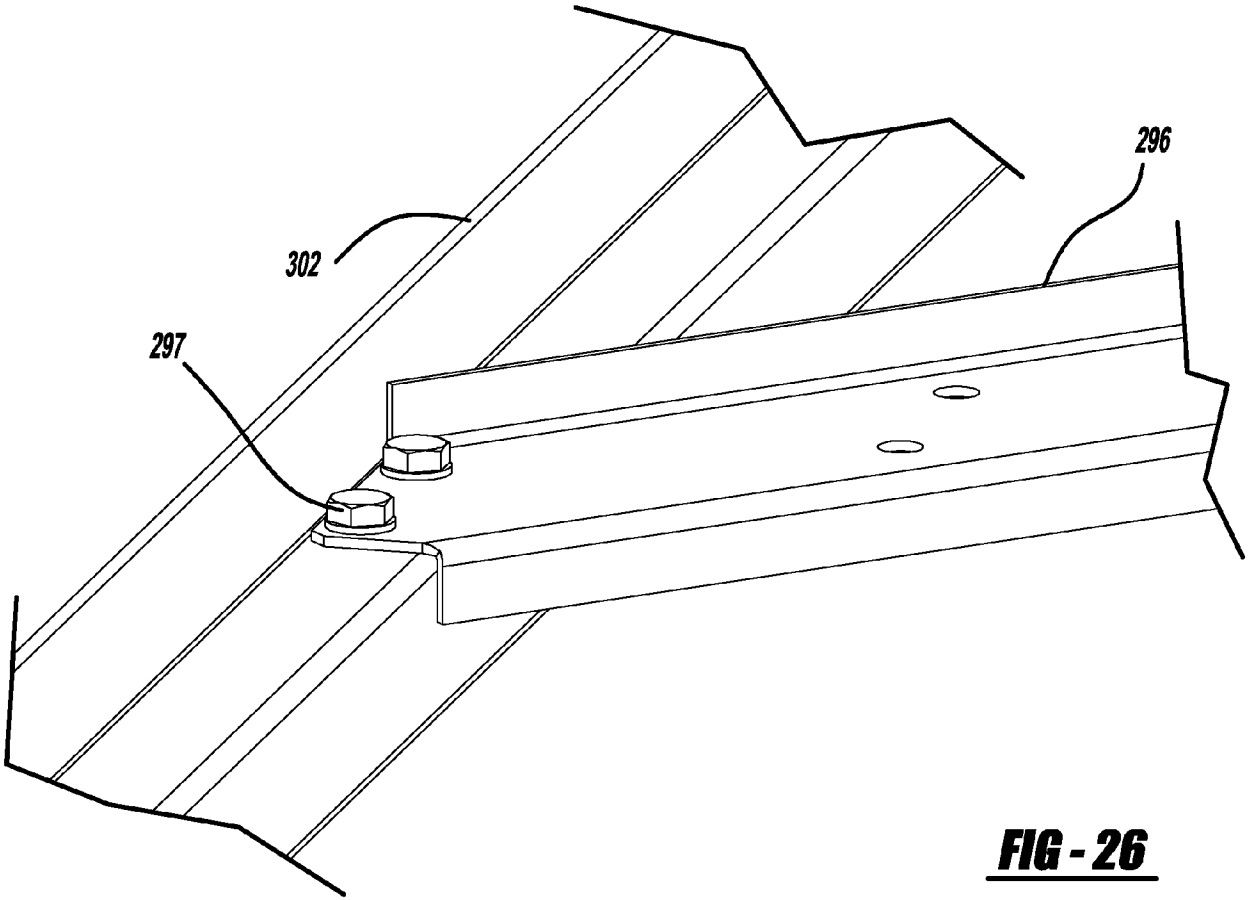
FIG. 26 illustrates the cross bracing used in the sootblower frame assembly illustrated in FIG. 24.

FIG. 26 illustrates the use of cross braces 296 which can be used to separate and support the side panel assemblies 286 and 288. As shown, preformed holes are provided for access to threaded fasteners 297.

Figure 27:
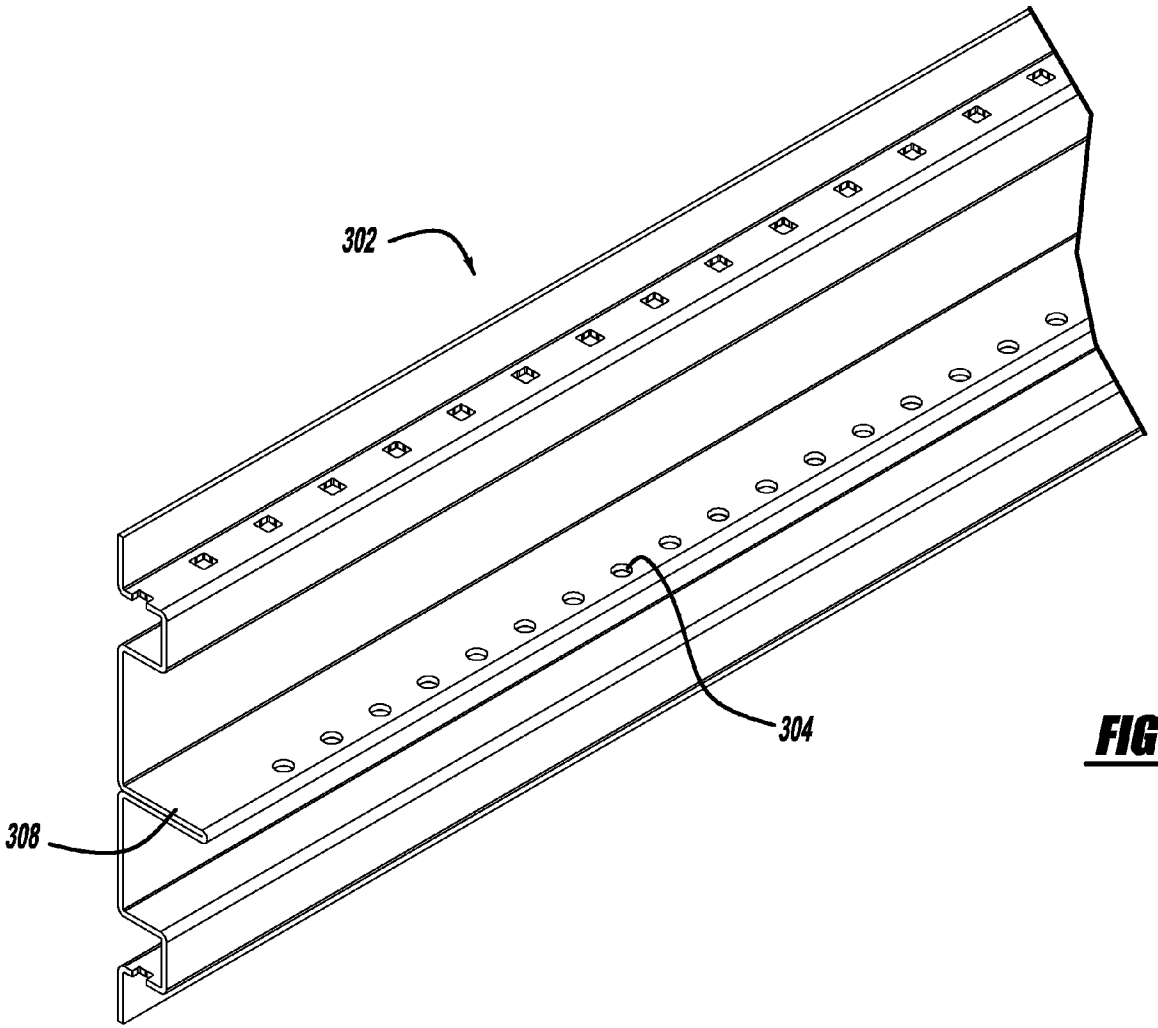
FIG. 27 is a side elevational view of a side rail for a frame assembly in accordance with a fifteenth embodiment of this invention.

FIG. 27 illustrates a side panel in accordance with a fifteenth embodiment of this invention, generally designated by reference number 302. Side panel 302 incorporates a cross-sectional configuration generally equivalent to side panel 104 illustrated in FIG. 8. However, side panel 302 incorporates a series of regularly spaced holes or apertures 304 through horizontal center track flange 308. Apertures 304 are provided to enable a specialized roller having projecting posts or teeth to directly engage with the apertures for driving carriage 18 along the length of side panel 302. Side panel 302 could therefore be used without a separate toothed track assembly as shown in the prior embodiments, since its function would be served by the perforations of track flange 308.

Figure 28:
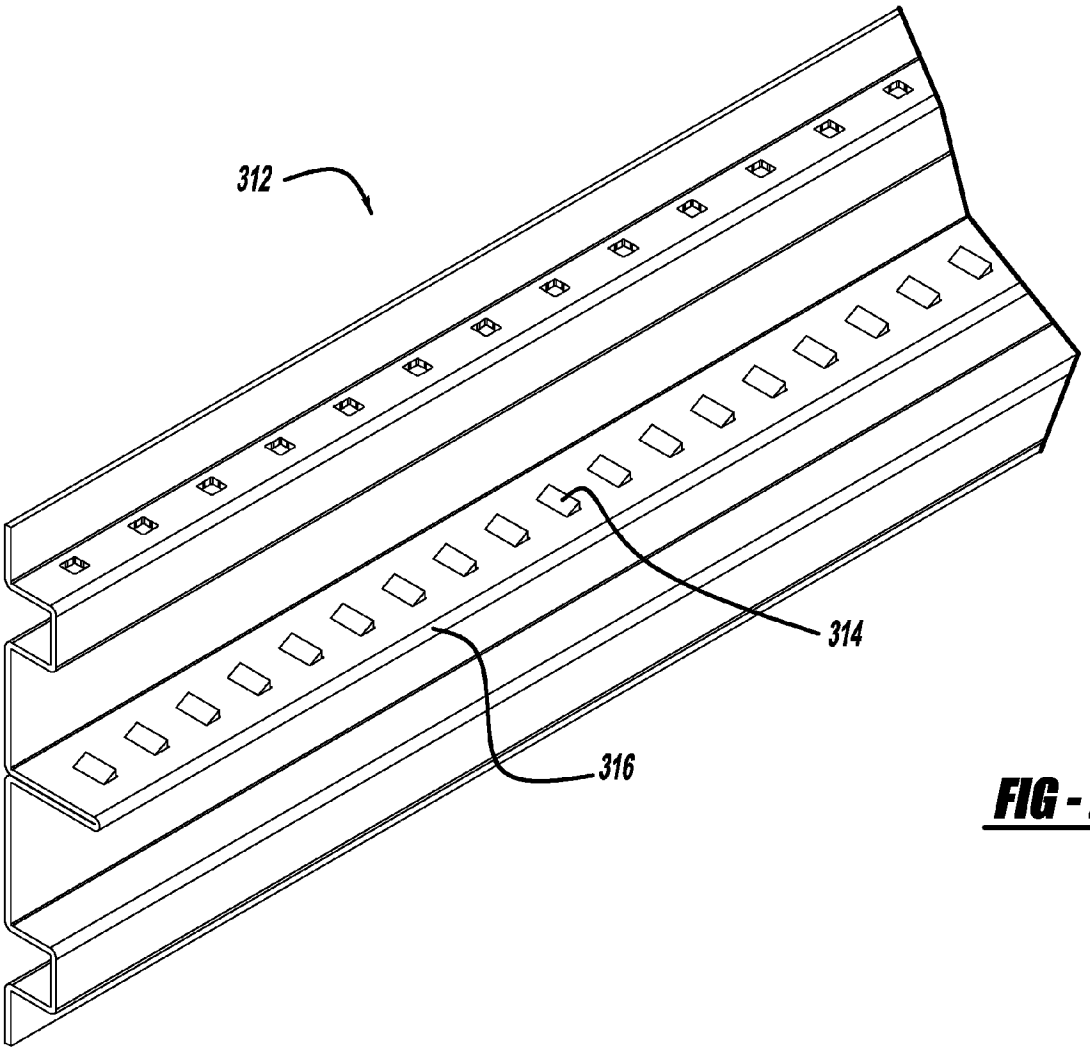
FIG. 28 is a side elevational view of a side rail for a frame assembly in accordance with a sixteenth embodiment of this invention.

Now with reference to FIG. 28, side panel 312 is illustrated in accordance with a sixteenth embodiment of this invention. Side panel 312 is generally equivalent to side panel 302 except that instead of featuring apertures 304 through track flange 308, rectangular tabs 314 are perforated and deflected from track flange 316. Tabs 314 perform a function similar to that of apertures 304 in that they enable an appropriately shaped drive cog or gear to engage directly with track flange 316 for driving the carriage along the length of side panel 312.

Figure 29:
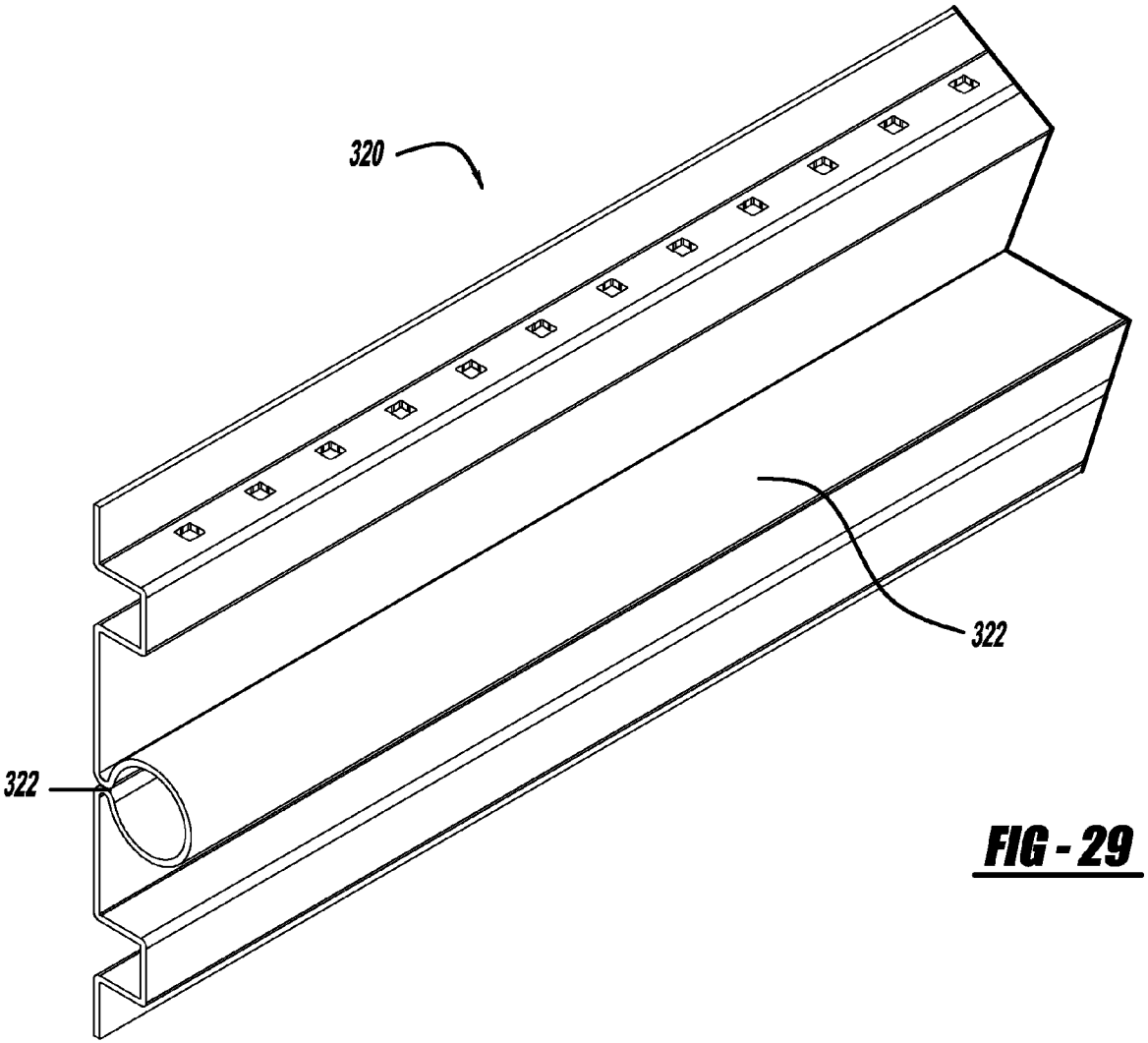
FIG. 29 is a side elevational view of a side rail for a frame assembly in accordance with a seventeenth embodiment of this invention.

FIG. 29 illustrates side panel 320 in accordance with a seventeenth embodiment of the present invention. In this instance, rather than providing a flat horizontal track flange, such as that illustrated in FIGS. 8, 27 and 28, side panel 320 forms a center formed tubular flange 322. Tubular flange 322 has a generally round inside and outside cross-sectional shape. Tubular flange 322 could be used with a specialized carriage roller (not shown) very similar to the roller 280 shown in FIG. 23 which has a concave perimeter surface shape. The design illustrated for side panel 320 could further, however, be usable with rollers which also act as the drive for the carriage 18 which eliminates the requirement for a separate pinion gear engaged with a toothed rack. In order to enhance frictional engagement, it may be possible to engage both the lower and upper surfaces of tubular flange 322 using a pair of suitably profiled rollers which pinch and compress tubular flange 322 for driving the carriage.

Figure 30:
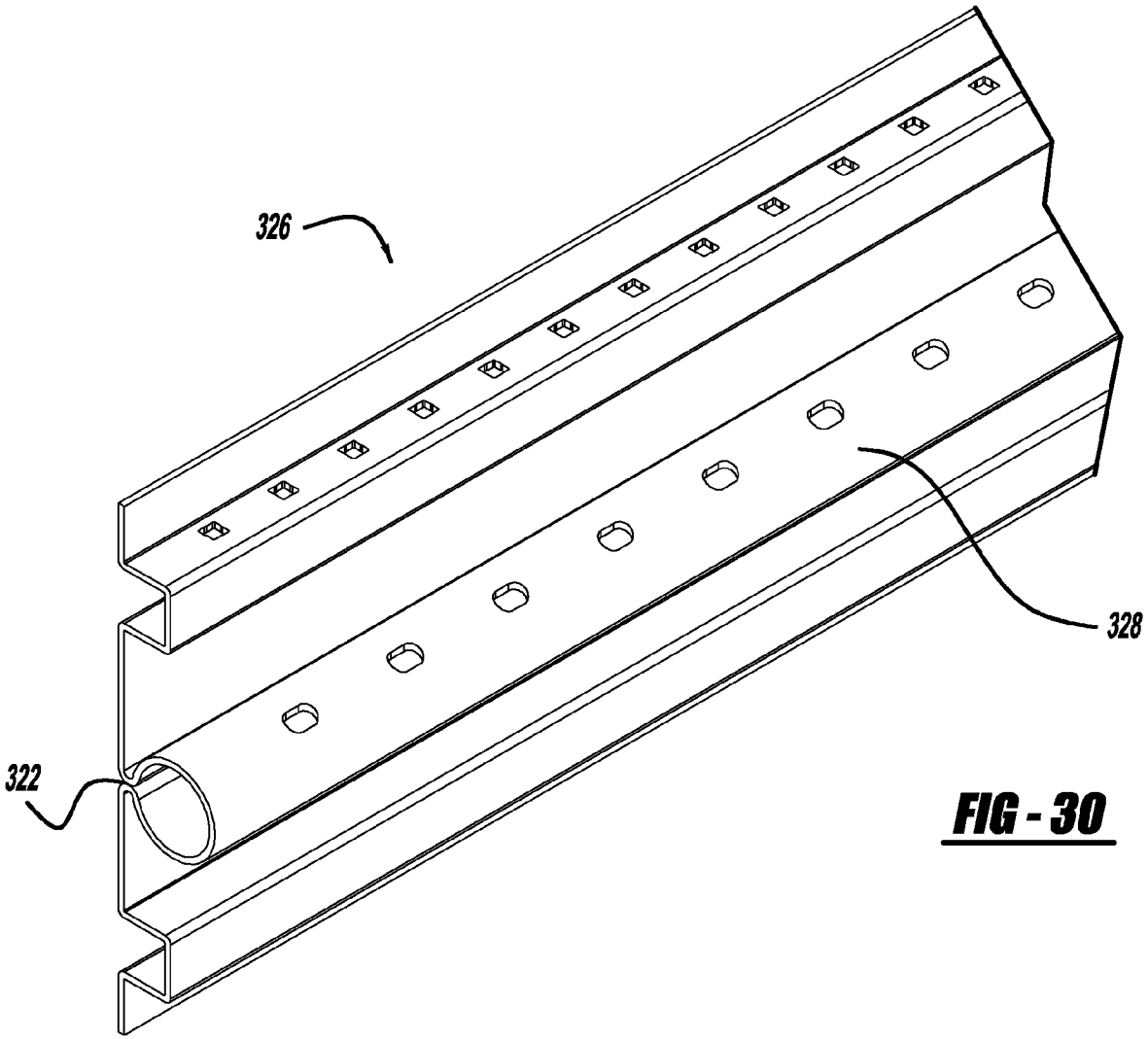
FIG. 30 is a side elevational view of a side rail for a frame assembly in accordance with a eighteenth embodiment of this invention.

FIG. 30 illustrates side panel 326 in accordance with an eighteenth embodiment of the present invention. Side panel 326 is generally identical to side panel 320 except that tubular flange 328 is perforated by apertures 230 in a manner similar to that described in connection with FIG. 27. Suitably shaped drive rollers with projecting teeth, studs, or cogs are engageable with apertures 330 for the purpose of driving the carriage along the length of side panel 326.

In the embodiments illustrated in FIGS. 29 and 30, the structural integrity and torsional stiffness of the associated side panels can be enhanced by providing a weld bead or braze bead along the bite portion 322 in which the tubular flanges 322 and 328 are necked down.

Figure 31:
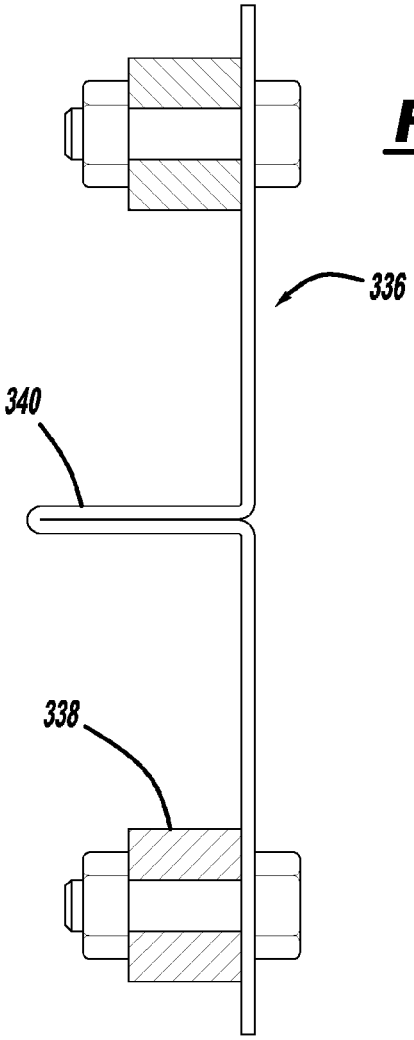
FIG. 31 is a cross-sectional view through a side panel for a frame assembly in accordance with a nineteenth embodiment of this invention.

FIG. 31 illustrates a side panel in accordance with a nineteenth embodiment of this invention and is generally designated by reference number 336. Side panel 336 differs from the prior embodiments in that in this instance, the lower roller track surface is defined by a separately installed track bar 338 which is bolted or otherwise fastened to side panel 336. In this embodiment, the upper track surface is defined by center track flange 340 which is formed from the sheet metal material forming the remainder of side panel 336, as in the case of prior embodiments. The track bar 338 at the top of FIG. 31, does not serve to guide the roller, but serves as a stiffener for the side panel 336.

Figure 32:
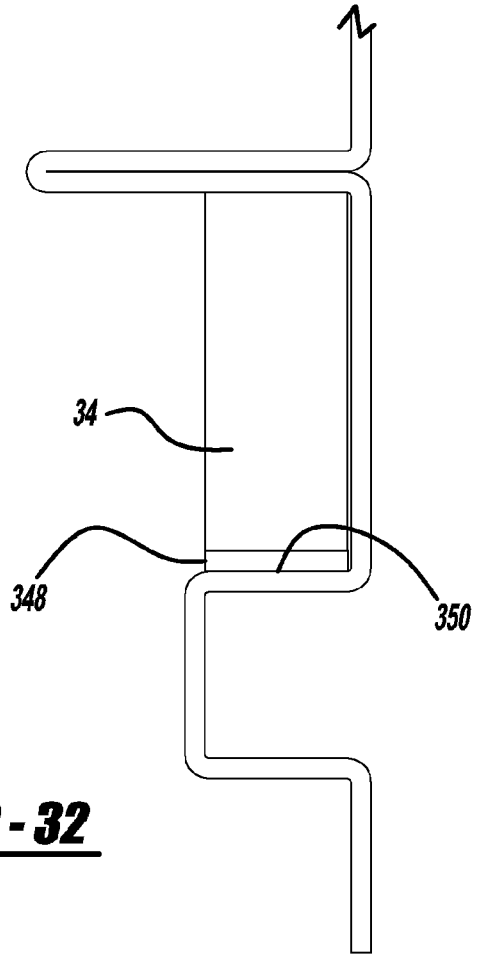
FIG. 32 is a partial cross-sectional view of a side panel of a frame assembly in accordance with a twentieth embodiment of this invention.

FIG. 32 is a cross-sectional view of a side panel in accordance with a twentieth embodiment of this invention and is generally designated by reference number 346. In this case, the carriage roller 24 does not directly bear on the lower track surface of the side panel, but rather rides on track bar 348 which is resting on horizontal track surface 350. In the event that wear is encountered in the operation of the associated sootblower, track bar 348 can be removed and replaced as needed. Track bar 348 may be retained in position through the use of threaded fasteners through apertures in track surface 350 (not shown) or other suitable fastening techniques such as adhesive, brazing, or other fixing approaches could be implemented.

In many of the embodiments described in connection with this invention, each of the two side panels are symmetrically identical to one another. However, it would be possible to vary the configuration of the left-hand and right-hand side panels as desired for particular applications. In fact, many of the side sections described in the specification may be interchanged with one another in such an assembly.

While numerous embodiments of this invention are disclosed, they have certain common features. First, one or both of the support roller track surfaces are formed by the frame assembly side panel or a similar rail structure. Secondly, the interaction between the carriage support rollers and the guide track surfaces produces loads on the frame assembly which primarily act in the vertical direction.

While the above description constitutes the preferred embodiment of the present invention, it will be apparent that the invention is susceptible to modification, variation and change without departing from the proper scope and fair meaning of the accompanying claims.

The invention claimed is:

1. A frame assembly for a sootblower for projecting a stream of a fluid blowing medium against internal surfaces of a combustion device, the sootblower of the type having a lance tube and a carriage which carries the lance tube causing it to be periodically advanced into and retracted from the interior of the combustion device, the carriage of the type having one or more support rollers and a drive pinion gear, the support rollers and the drive pinion gear being rotatable about generally horizontal axes and the drive pinion gear meshing with a toothed rack for driving the carriage along the frame assembly, the frame assembly comprising:

a pair of elongated side panels, the side panels formed of substantially uniform thickness metal stock formed to integrally define a first generally horizontal panel track surface, a second generally horizontal panel track surface and a vertical panel track surface extending between the first and the second track surfaces, the first track surface, the second track surface and the vertical panel track surface cooperating to define a roller channel extending substantially the entire length of the side panels for supporting the support rollers to roll along the side panels and to trap the support rollers within the roller channel, the toothed rack affixed to or defined by at least one of the first track surface and the second track surface.

2. The frame assembly in accordance with claim 1 further comprising the side panels further defining the roller channel opening inwardly formed in part by the first track surface which extends inwardly.

3. The frame assembly in accordance with claim 1 further comprising the side panels forming a pocket.

4. The frame assembly in accordance with claim 1 further comprising the first track surface formed by a reversely bent flange.

5. The frame assembly in accordance with claim 1 further comprising the second track surface formed by a reversely bent flange.

6. The frame assembly in accordance with claim 1 further comprising the pair of the side panels including a right-hand side panel and a left-hand side panel and a top panel extending between the right-hand side panel and the left-hand side panel so as to enclose the carriage.

7. The frame assembly in accordance with claim 6 further comprising the top panel being integrally formed with the right-hand side panel and the left-hand side panel.

8. The frame assembly in accordance with claim 1 further comprising one or more tie bars connecting a pair of the side panels together to define a right-hand side panel and a left-hand side panel.

9. The frame assembly in accordance with claim 1 further comprising the frame assembly forming a forward end for positioning adjacent to the combustion device and a rearward end for positioning spaced from the combustion device, the sootblower having a rear module attachable to the side panels and having rail track surfaces for supporting the support rollers and the rear module having means for enabling removal of the carriage from the sootblower.

10. The frame assembly in accordance with claim 1 further comprising the carriage rollers engaging the first track surface to restrain loads primarily acting in the vertical direction.

11. The frame assembly in accordance with claim 1 further comprising the side panels having a corrosion resistant coating substantially covering an entire exterior surface of the side panels.

12. The frame assembly in accordance with claim 11 further comprising the corrosion resistant coating is a galvanizing coating.

13. The frame assembly in accordance with claim 1 further comprising at least one of the first or the second track surface having a flange for trapping the roller.

14. The frame assembly in accordance with claim 1 further comprising the first track surface formed by a projecting flange having a round cross-sectional shape.

15. The frame assembly in accordance with claim 1 further comprising the first track surface having a plurality of perforations for engagement with the roller so that the first track defines the toothed rack.

16. The frame assembly in accordance with claim 1 further comprising the first track surface having a track bar disposed thereon for engagement with the carriage roller.

17. The frame assembly in accordance with claim 1 further comprising the toothed rack being affixed to at least one of the first track surface and the second track surface and positioned inwardly of the roller channel to trap at least one of the support rollers between the toothed rack and the vertical panel surface.

18. A frame assembly for a sootblower for projecting a stream of a fluid blowing medium against internal surfaces of a combustion device, the sootblower of the type having a lance tube and a carriage which carries the lance tube causing it to be periodically advanced into and retracted from the interior of the combustion device, the carriage of the type having one or more support rollers and a drive pinion gear, the support rollers and the drive pinion gear being rotatable about generally horizontal axes and the drive pinion gear meshing with a toothed rack, the frame assembly comprising:

a pair of elongated side panels, the side panels formed of substantially uniform thickness metal stock formed to integrally define a first generally horizontal panel track surface, a second generally horizontal panel track surface and a vertical panel track surface extending between the first and the second track surfaces, the first track surface, the second track surface and the vertical panel track surface cooperating to define a roller channel extending substantially the entire length of the side panels for supporting the support rollers to roll along the side panels and to trap the support rollers within the roller channel, the toothed rack affixed to or defined by at least one of the first track surface and the second track surface and the second track surface extending inwardly a greater distance than the first track surface.

19. The frame assembly in accordance with claim 18 wherein the toothed rack is affixed to the second track surface with teeth of the toothed rack facing downwardly.

20. A frame assembly for a sootblower for projecting a stream of a fluid blowing medium against internal surfaces of a combustion device, the sootblower of the type having a lance tube and a carriage which carries the lance tube causing it to be periodically advanced into and retracted from the interior of the combustion device, the carriage of the type having one or more support rollers and a drive pinion gear, the support rollers and the drive pinion gear being rotatable about generally horizontal axes and the drive pinion gear meshing with a toothed rack, the frame assembly comprising:

a pair of elongated side panels, the side panels formed of substantially uniform thickness metal stock formed to integrally define a first generally horizontal panel track surface, a second generally horizontal panel track surface and a vertical panel track surface extending between the first and the second track surfaces, the first track surface, the second track surface and the vertical panel track surface cooperating to define a roller channel extending substantially the entire length of the side panels for supporting the support rollers to roll along the side panels and to trap the support rollers within the roller channel, the toothed rack affixed to or defined by at least one of the first track surface and the second track surface, further comprising the side panels forming a pocket, a bar fastened within the pocket for enabling multiple track surfaces of the side panels to be connected together.

21. The frame assembly in accordance with claim 20 further comprising the pocket opening outwardly.

22. A frame assembly for a sootblower for projecting a stream of a fluid blowing medium against internal surfaces of a combustion device, the sootblower of the type having a lance tube and a carriage which carries the lance tube causing it to be periodically advanced into and retracted from the interior of the combustion device, the carriage of the type having one or more support rollers and a drive pinion gear, the support rollers and the drive pinion gear being rotatable about generally horizontal axes and the drive pinion gear meshing with a toothed rack, the frame assembly comprising:

a pair of elongated side panels, the side panels formed of substantially uniform thickness metal stock formed to integrally define a first generally horizontal panel track surface, a second generally horizontal panel track surface and a vertical panel track surface extending between the first and the second track surfaces, the first track surface, the second track surface and the vertical panel track surface cooperating to define a roller channel extending substantially the entire length of the side panels for supporting the support rollers to roll along the side panels and to trap the support rollers within the roller channel, the toothed rack affixed to or defined by at least one of the first track surface and the second track surface the side panels each forming a first and a second roller channel, the first and the second roller channels having vertical spacings which are different whereby the side panels can accept rollers of different diameters.

23. A frame assembly for a sootblower for projecting a stream of a fluid blowing medium against internal surfaces of a combustion device, the sootblower of the type having a lance tube and a carriage which carries the lance tube causing it to be periodically advanced into and retracted from the interior of the combustion device, the carriage of the type having one or more support rollers and a drive pinion gear, the support rollers and the drive pinion gear being rotatable about generally horizontal axes and the drive pinion gear meshing with a toothed rack, the frame assembly comprising:

a pair of elongated side panels, the side panels formed of substantially uniform thickness metal stock formed to integrally define a first generally horizontal panel track surface, a second generally horizontal panel track surface and a vertical panel track surface extending between the first and the second track surfaces, the first track surface, the second track surface and the vertical panel track surface cooperating to define a roller channel extending substantially the entire length of the side panels for supporting the support rollers to roll along the side panels and to trap the support rollers within the roller channel, the toothed rack affixed to or defined by at least one of the first track surface and the second track surface, the side panels forming profile track surfaces having "T" shaped channels for receiving fasteners.

24. A frame assembly for a sootblower for projecting a stream of a fluid blowing medium against internal surfaces of a combustion device, the sootblower of the type having a lance tube and a carriage which carries the lance tube causing it to be periodically advanced into and retracted from the interior of the combustion device, the carriage of the type having one or more support rollers and a drive pinion gear, the support rollers and the drive pinion gear being rotatable about generally horizontal axes and the drive pinion gear meshing with a toothed rack, the frame assembly comprising:

a pair of elongated side panels, the side panels formed of substantially uniform thickness metal stock formed to integrally define a first generally horizontal panel track surface, a second generally horizontal panel track surface and a vertical panel track surface extending between the first and the second track surfaces, the first track surface, the second track surface and the vertical panel track surface cooperating to define a roller channel extending substantially the entire length of the side panels for supporting the support rollers to roll along the side panels and to trap the support rollers within the roller channel, the toothed rack affixed to or defined by at least one of the first track surface and the second track surface, one or more of the side panels formed by a plurality of separately formed panel track surfaces affixed together to form the side panel.

25. The frame assembly in accordance with claim 24 further comprising the panel track surfaces cooperating with the side panels to define enclosed track surfaces forming cavities.

26. A frame assembly for a sootblower for projecting a stream of a fluid blowing medium against internal surfaces of a combustion device, the sootblower of the type having a lance tube and a carriage which carries the lance tube causing it to be periodically advanced into and retracted from the interior of the combustion device, the carriage of the type having one or more support rollers and a drive pinion gear, the support rollers and the drive pinion gear being rotatable about generally horizontal axes and the drive pinion gear meshing with a toothed rack, the frame assembly comprising:

a pair of elongated side panels, the side panels formed of substantially uniform thickness metal stock formed to integrally define a first generally horizontal panel track surface, a second generally horizontal panel track surface and a vertical panel track surface extending between the first and the second track surfaces, the first track surface, the second track surface and the vertical panel track surface cooperating to define a roller channel extending substantially the entire length of the side panels for supporting the support rollers to roll along the side panels and to trap the support rollers within the roller channel, the toothed rack affixed to or defined by at least one of the first track surface and the second track surface, the first and the second track surfaces having a crowned surface for engaging the carriage roller and the roller having a complementary shaped crowned profile surface.

27. A frame for a sootblower for projecting a stream of a fluid blowing medium against internal surfaces of a combustion device, the sootblower of the type having a lance tube and a carriage which carries the lance tube causing it to be periodically advanced into and retracted from the interior of the combustion device, the carriage of the type having one or more support rollers and a drive pinion gear meshing with a toothed rack affixed to the frame for driving the carriage along the frame assembly, the frame comprising:

a pair of elongated side panels including a right-hand side panel and a left-hand side panel, the side panels made of substantially uniform thickness metal stock each formed to integrally define an inwardly facing channel, each having a lower surface defined by a first horizontal panel track surface for allowing the support rollers to roll along the side panels and each having an upper surface defined by a second horizontal panel track surface for mounting the toothed rack to the side panels with the first and second track surfaces joined by a first track surface, at least one of the first track surface and the second track surface formed by a reversely bent flange.

28. A frame for a sootblower for projecting a stream of a fluid blowing medium against internal surfaces of a combustion device, the sootblower of the type having a lance tube and a carriage which carries the lance tube causing it to be periodically advanced into and retracted from the interior of the combustion device, the carriage of the type having one or more support rollers and a drive pinion gear meshing with a toothed rack affixed to the frame, the frame comprising:

a pair of elongated side panels including a right-hand side panel and a left-hand side panel, the side panels made of substantially uniform thickness metal stock each formed to integrally define an inwardly facing channel, each having a lower surface defined by a first horizontal panel track surface for allowing the support rollers to roll along the side panels and each having an upper surface defined by a second horizontal panel track surface for mounting the toothed rack to the side panels with the first and second track surfaces joined by a first track surface, at least one of the first track surface and the second track surface formed by a reversely bent flange, wherein the toothed rack is fastened to the second track surface inboard of the support roller with teeth of the toothed rack facing downwardly.

29. A frame assembly for a sootblower for projecting a stream of a fluid blowing medium against internal surfaces of a combustion device, the sootblower of the type having a lance tube and a carriage which carries the lance tube causing it to be periodically advanced into and retracted from the interior of the combustion device, the carriage of the type having one or more support rollers and a drive pinion gear, the support rollers and the drive pinion gear being rotatable about generally horizontal axes and the drive pinion gear meshing with a toothed rack for driving the carriage along the frame assembly, the frame assembly comprising:

a pair of elongated side rails, the side rails formed of substantially uniform thickness metal stock formed to integrally define a first generally horizontal track surface, a second generally horizontal track surface and a vertical track surface extending between the first and the second track surfaces, the first track surface, the second track surface and the vertical track surface cooperating to define a roller channel extending substantially the entire length of the side rails for supporting the support rollers to roll along the side rails and to trap the support rollers within the roller channel, the toothed rack affixed to or defined by at least one of the first track surface and the second track surface.

30. The frame assembly in accordance with claim 29 further comprising the side rails further defining the roller channel opening inwardly formed in part by the first track surface which extends inwardly.

31. The frame assembly in accordance with claim 29 further comprising the second track surface extending inwardly a greater distance than the first track surface.

32. The frame assembly in accordance with claim 29 wherein the toothed rack is affixed to the second track surface with teeth of the toothed rack facing downwardly.

33. The frame assembly in accordance with claim 29 further comprising the side rails forming a pocket.

34. The frame assembly in accordance with claim 33 further comprising the pocket opening outwardly.

35. The frame assembly in accordance with claim 29 further comprising the carriage rollers engaging the first track surface to restrain loads primarily acting in the vertical direction.

36. The frame assembly in accordance with claim 29 further comprising the toothed rack being affixed to at least one of the first track surface and the second track surface and positioned inwardly of the roller channel to trap at least one of the support rollers between the toothed rack and the vertical panel surface.

37. The frame assembly in accordance with claim 29 further comprising the side rails each affixed to a side panel.

38. The frame assembly in accordance with claim 37 further comprising the side rails each affixed to a side panel by bolts.

39. The frame assembly in accordance with claim 37 further comprising the side panel having upper and lower "T" slot sections enabling individual sections of the side panels to be connected together using a bar inserted within the "T" slots.

* * * * *